US005491956A

United States Patent [19]

Donnelly et al.

[11] Patent Number: 5,491,956

[45] Date of Patent: Feb. 20, 1996

[54] VARIABLE STRETCH DETACKIFICATION ADHESIVE TAPE UNITIZER SYSTEM

[75] Inventors: Craig S. Donnelly, Hager City, Wis.; Daniel G. Michalski, Red Wing, Minn.; David W. Carroll, Northfield, Minn.; Robert L. Cahlander; Thomas E. Jung, both of Red Wing, Minn.; James D. Ramacier, Hugo, Minn.

[73] Assignee: Minnesota Mining and Manufacturing Company, St. Paul, Minn.

[21] Appl. No.: 166,611

[22] Filed: Dec. 13, 1993

Related U.S. Application Data

[63] Continuation of Ser. No. 892,220, Jun. 2, 1992, abandoned.

[51] Int. Cl.[6] ..... B65B 53/00; B65B 13/02

[52] U.S. Cl. ..... 53/399; 53/441; 53/556; 53/587

[58] Field of Search ..... 53/176, 214, 399, 53/441, 449, 587, 556, 137.2, 419

[56] References Cited

U.S. PATENT DOCUMENTS

| | | | |
|---|---|---|---|
| 2,023,147 | 12/1935 | Petskeyes | 93/2 |
| 2,972,843 | 2/1961 | duBroff | 53/74 |
| 3,239,994 | 3/1966 | Etzel et al. . | |
| 3,535,189 | 10/1970 | Hall et al. | 156/486 |
| 3,574,270 | 4/1971 | Rosendahl | 53/281 |
| 3,574,291 | 4/1971 | Rosendahl | 83/175 |
| 3,628,305 | 12/1971 | Owen . | |
| 3,632,268 | 1/1972 | Pomernacki | 425/348 |
| 3,675,388 | 7/1972 | Lems . | |
| 3,793,798 | 2/1974 | Lancaster, III et al. . | |
| 3,839,122 | 10/1974 | Current et al. | 156/351 |
| 3,867,806 | 2/1975 | Lancaster, III et al. . | |
| 3,910,005 | 10/1975 | Thimon | 53/441 X |
| 3,930,442 | 1/1976 | Buttner | 100/18 |
| 3,946,535 | 3/1976 | Bourgeois et al. . | |
| 3,968,621 | 7/1976 | Poupitch | 53/52 |
| 3,991,640 | 11/1976 | Schlueter | 83/341 |
| 4,033,457 | 7/1977 | Weaver | 206/390 |
| 4,050,221 | 9/1977 | Lancaster | 53/556 X |
| 4,079,565 | 3/1978 | Lancaster, III et al. . | |
| 4,095,395 | 6/1978 | Goldstein | 53/210 |
| 4,109,445 | 8/1978 | Shulman | 53/210 |
| 4,169,343 | 10/1979 | McArdle | 53/398 |
| 4,178,734 | 12/1979 | Lancaster et al. | 53/399 |

(List continued on next page.)

FOREIGN PATENT DOCUMENTS

| | | | |
|---|---|---|---|
| 246659 | 11/1987 | European Pat. Off. | 53/441 |
| 433718 | 6/1991 | European Pat. Off. . | |
| 3200220 | 7/1983 | Germany | 53/587 |
| 3409117 | 9/1985 | Germany | 53/441 |
| 198286 | 7/1985 | New Zealand . | |
| 2083002 | 3/1982 | United Kingdom . | |

OTHER PUBLICATIONS

Translation of Article from German Trade Journal PACK REPORT, May 1991, pp. 98–99, Palette Stabilization, Alternative to Film.

"Unitizing: How to Get it All Together–and Keep it That Way", Package Engineering, Aug. 1980, pp. 27–30.

*Primary Examiner*—Linda Johnson

*Attorney, Agent, or Firm*—Merchant, Gould, Smith, Edell, Welter & Schmidt

[57] ABSTRACT

A dispenser apparatus comprised of a stretchable adhesive tape which is detackified when stretched longitudinally. The tape is advanced through a stretching station to an array of articles to be unitized. Tension rollers are utilized on either side of the stretching station to ensure that the tape advances evenly and does not recoil. The dispenser apparatus also includes a first prime mover which advances the tape through the tension rollers and stretching station at a rate which ensures proper stretching (at predetermined intervals) and proper feeding of the tape to the array of boxed items. A controller simultaneously controls the z-axis motion (of the dispenser and rotation of the articles to be unitized. Therefore, both the number of wraps about the articles and the location of the wraps between the base of the articles and the top of the articles may be controlled.

26 Claims, 10 Drawing Sheets

U.S. PATENT DOCUMENTS

| | | | |
|---|---|---|---|
| 4,204,377 | 5/1980 | Lancaster et al. | 53/399 |
| 4,209,961 | 7/1980 | Donnelley | 53/588 |
| 4,230,519 | 10/1980 | DuBroff | 156/468 |
| 4,232,501 | 11/1980 | Stackhouse | 53/399 |
| 4,235,062 | 11/1980 | Lancaster, III et al. | 53/399 |
| 4,255,918 | 3/1981 | Lancaster et al. | 53/556 |
| 4,271,657 | 6/1981 | Lancaster, III et al. | 53/399 |
| 4,300,326 | 11/1981 | Stackhouse | 53/211 |
| 4,302,920 | 12/1981 | Lancaster et al. | 53/399 |
| 4,317,322 | 3/1982 | Lancaster et al. | 53/399 |
| 4,324,085 | 4/1982 | Olsen . | |
| 4,354,333 | 10/1982 | McArdle . | |
| 4,365,710 | 12/1982 | Swanson | 206/386 |
| 4,369,614 | 1/1983 | Tetzner | 53/556 |
| 4,387,548 | 6/1983 | Lancaster et al. | 53/399 |
| 4,387,552 | 6/1983 | Lancaster et al. | 53/556 |
| 4,413,463 | 11/1983 | Lancaster | 53/399 |
| 4,428,720 | 1/1984 | Van Erden et al. | 425/66 |
| 4,429,514 | 2/1984 | Lancaster et al. | 53/556 |
| 4,432,185 | 2/1984 | Geisinger | 53/587 |
| 4,458,467 | 7/1984 | Shulman | 53/441 X |
| 4,488,340 | 12/1984 | Rayburn | 29/25.42 |
| 4,497,159 | 2/1985 | Lancaster, III | 53/556 |
| 4,514,955 | 5/1985 | Mouser et al. | 53/64 |
| 4,524,568 | 6/1985 | Lancaster et al. | 53/556 |
| 4,535,951 | 8/1985 | Riemenschneider, III | 242/754 |
| 4,545,182 | 10/1985 | McDowell, Jr. | 53/556 |
| 4,549,388 | 10/1985 | Lancaster | 53/556 |
| 4,553,374 | 11/1985 | Lancaster et al. | 53/465 |
| 4,563,863 | 1/1986 | Humphrey | 53/556 |
| 4,624,363 | 11/1986 | Edwards | 206/150 |
| 4,663,915 | 5/1987 | Van Erden et al. | 53/450 |
| 4,671,043 | 6/1987 | Forni et al. | 53/399 |
| 4,676,048 | 6/1987 | Lancaster et al. | 53/399 |
| 4,691,497 | 9/1987 | Lancaster | 53/399 |
| 4,693,060 | 9/1987 | Born | 53/588 |
| 4,706,442 | 11/1987 | Riemenschneider | 53/556 |
| 4,712,686 | 12/1987 | Lancaster et al. | 206/597 |
| 4,722,170 | 2/1988 | Ball et al. | 53/556 |
| 4,735,033 | 4/1988 | Stackhouse | 53/399 |
| 4,738,079 | 4/1988 | Lancaster et al. | 53/450 |
| 4,741,729 | 5/1988 | Edwards | 493/339 |
| 4,745,726 | 5/1988 | Rosenthal et al. | 53/77 |
| 4,747,254 | 5/1988 | Lancaster | 53/556 |
| 4,756,143 | 7/1988 | Lancaster | 53/556 |
| 4,761,934 | 8/1988 | Lancaster | 53/399 |
| 4,765,120 | 8/1988 | Phillips | 53/441 |
| 4,769,283 | 9/1988 | Sipinen et al. | 428/343 |
| 4,772,256 | 9/1988 | Lane et al. | 604/4 |
| 4,775,360 | 10/1988 | Lane et al. | 604/4 |
| 4,779,396 | 10/1988 | Stackhouse | 53/399 |
| 4,807,427 | 2/1989 | Casteel et al. | 53/556 |
| 4,841,711 | 6/1989 | Lems et al. | 53/398 |
| 4,843,312 | 5/1989 | Riemenschneider, III | 242/96 |
| 4,845,920 | 7/1989 | Lancaster | 53/399 |
| 4,858,415 | 8/1989 | Hake | 53/438 |
| 4,884,385 | 12/1989 | Mushinski | 53/399 |
| 4,901,581 | 2/1990 | Fain et al. | 73/795 |
| 4,905,451 | 3/1990 | Jaconelli | 53/587 X |
| 4,905,455 | 3/1990 | Horner | 53/441 |
| 4,955,181 | 9/1990 | Casteel | 53/556 |
| 4,963,430 | 10/1990 | Kish et al. | 428/220 |
| 4,991,381 | 2/1991 | Simons | 53/556 |
| 4,995,224 | 2/1991 | Yourgalite et al. | 53/540 |
| 4,998,619 | 3/1991 | Sowa et al. | 206/392 |
| 5,003,752 | 4/1991 | Matsumoto | 53/399 |
| 5,014,498 | 5/1991 | McMahon | 53/451 |
| 5,020,300 | 6/1991 | Casteel | 53/399 |
| 5,040,358 | 8/1991 | Thimon | 53/556 |
| 5,046,709 | 9/1991 | Beal | 270/30 |
| 5,048,261 | 9/1991 | Lancaster, III et al. | 53/399 |
| 5,056,653 | 10/1991 | Lancaster | 198/790 |
| 5,088,270 | 2/1992 | Diehl | 53/399 |
| 5,117,609 | 6/1992 | Seymour et al. | 53/398 |
| 5,121,997 | 6/1992 | La Pierre et al. | 383/203 |
| 5,140,800 | 8/1992 | Martin et al. | 53/441 |
| 5,155,970 | 10/1992 | Moore | 53/399 |
| 5,161,349 | 11/1992 | Lancaster, III et al. | 53/399 |

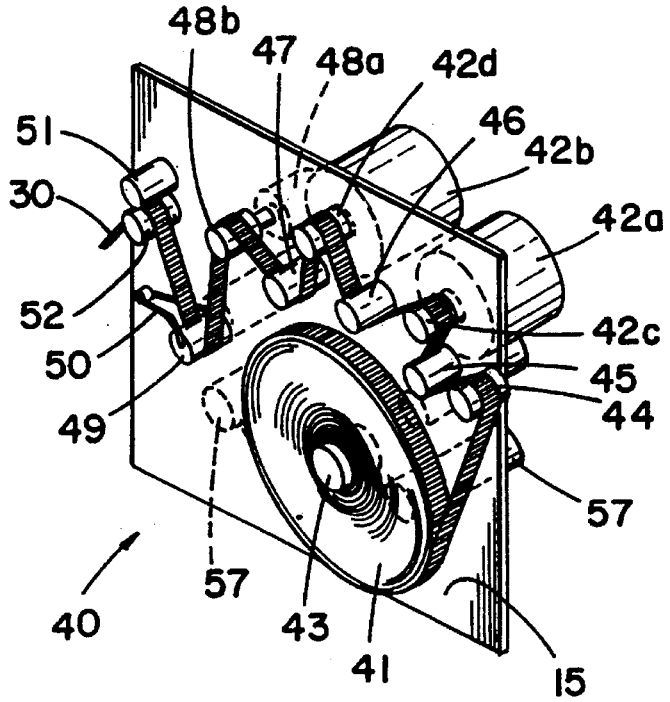
FIG. 3
FIG. 4
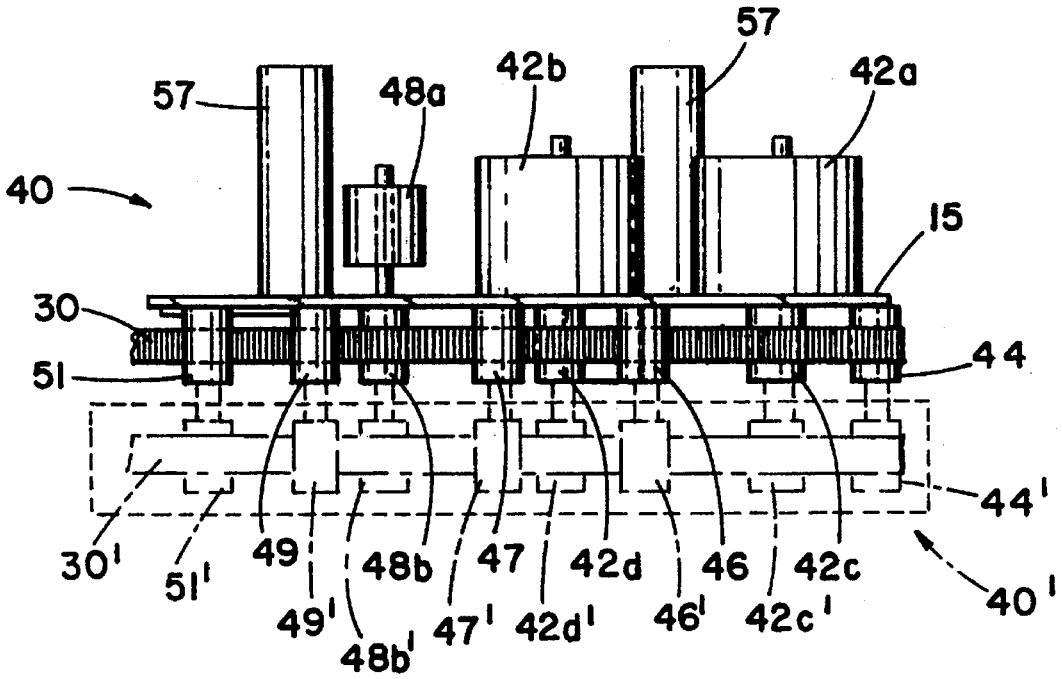

PLC
61
LIGHTS
62
STOP
START
RESET
MODE
63
RAM
ROM
64
RS-232
65
66
MOTOR CONTROLLER
67
CORNER SENSOR
HOME SENSOR
68
TURN-TABLE MOTOR
77
40
DANCER ARM CONTROL
75
MOTOR FOR STRETCH TAPE
48a
DANCER ARM POTENTIA-METER
76
CLUTCH 42a AND 42b
42
70
Z-AXIS MOTOR CONTROLLER
71
Z-AXIS MOTOR
72
LIMIT TOP
LIMIT BOTTOM
73
73a
73b
PHOTO-EYE
74
START POSITION
78

VARIABLE STRETCH DETACKIFICATION ADHESIVE TAPE UNITIZER SYSTEM

This is a continuation, of application Ser. No. 07/892,220, filed Jun. 2, 1992, now abandoned.

FIELD OF THE INVENTION

This invention relates generally to a dispenser system and more specifically to an apparatus for unitizing a plurality of articles utilizing a variable stretch detackification adhesive tape.

BACKGROUND OF THE INVENTION

In manufacturing and other settings, crated and boxed items are typically grouped together in a stacked arrangement to facilitate handling, storage, loading and shipping. However, as a consequence of placing the plurality of boxed items in stacked arrangement upon one another, the boxes must be secured in order to remain in place in the stack. The securing process is oftentimes referred to as "unitizing." A common form of unitizing includes the boxed items being placed upon a pallet (i.e., the boxed items are "palletized"). As those skilled in the art will appreciate, the boxed items are generally placed in a cube or other rectangular prism arrangement, with a plurality of boxes forming each of the several sides, top, and bottom. Accordingly, a typical stack of boxes may be considered a three dimensional array of boxes of l×m×n (in describing the present invention, an [x, y, z] Cartesian coordinate system will be discussed below, wherein l and m are variables which lie in a plane above and parallel to the x-y plane and n describes the height z above the x-y plane).

It will be immediately appreciated that numerous factors contribute to the stability (both vertical and lateral) of the array of boxes. The requirement for the lateral stability is increased as the unitized stack is moved from one location to another. For example, the stacking strength of a load of boxed items depends on the pattern or layout of each tier. In many instances a column stack yields the greatest vertical strength, but has little lateral stability. Other interlocking patterns increase lateral strength, at the expense of vertical strength, and may also improve the space utilization of the pallet. The balancing of these several factors (i.e., vertical strength, lateral stability, and space utilization) tends to produce a wide variety of pallet patterns depending on the type and size of the boxed items being unitized.

Since lateral stability is oftentimes sacrificed for optimization of space utilization and/or vertical stability, virtually every array requires some sort of restraining device. Previously, several methods have been utilized to unitize palletized arrays.

One example of a prior method comprised placing a net type device over the entire stack of boxed items, with the net then being gathered together about the base of the stack. This method, however, had several drawbacks. First, placing the net over the stack of boxed items required either being above the elevation of the stack or "casting" the net over the stack. Second, in addition to being bulky and cumbersome, a large supply of nets needed to be stocked in order to unitize the items in advance prior to shipping (or to merely move the palletized items within the confines of a warehouse).

Other methods which have been tried to improve lateral stability of stacks were the provision of a horizontal "strap" of material about the stack, use of an adhesive on the surfaces of the boxes which come into contact with one another, and shrink wrapping the palletized load. However, each of these methods suffers from drawbacks. First, strapping typically must be secured about the stack so tightly that damage to the boxes contacted by the strapping may result. Second, adhesives must provide a high shear strength to resist lateral forces, but low tensile strength in order to be disassembled without damaging the box. Third, the heat required for shrinkwrapping tended to require additional costs over other available methods.

The drawbacks associated with these methods lead to a method of unitizing by wrapping a stretch material about the array. Typical examples of this method of unitizing are illustrated by U.S. Pat. Nos. 4,549,388, 4,369,614, 4,429,514 and 4,095,395. In general these patents disclose devices which wind a plastic film about the stack of boxed items by securing the first end of the film to the pallet and then either rotating the pallet (relative to the supply of film) or moving the supply of film about the stack. The film is typically wound so as to form a completely overlapping "cocoon" of film about the stack. Thus, the entire outermost sides/edges of the stack of boxed items become encircled in the process of wrapping the plastic film. This method, however, suffers several drawbacks. First, a great amount of plastic film material is used which is not actually required to hold the items in place. This drawback is not only wasteful of the plastic material, but also adds unnecessary shipping costs. A second drawback is that the material must somehow be fastened at its first end which is inconvenient and time consuming. Finally, when the plastic is removed, it is not reusable so it must be either recycled or taken to a landfill. As previously noted, this last drawback is exacerbated since more plastic film is used than is required.

Additional U.S. patents disclose forming the sheet of plastic film material into a "rope" which is then wrapped about a portion of the array of items. In general, the roping devices merely gather the plastic film together from the film's side edges (about its longitudinal length) into an elongate continuous band. This process forms a high strength wrap which is typically used at the ends of the film wrapping process or to wrap about the items in various configurations. Examples of such devices are found in U.S. Pat. Nos. 4,845,920; 4,807,427; 4,204,377; 4,255,918; 4,432,185; and 4,235,062. However, each of the foregoing patents does not solve the problem of using a large amount of unneeded plastic film material and does not provide for a selectively releasable adhesive to secure the first or last end of the film during the wrapping procedure.

Therefore, there arises a need for a unitizer method and system which uses a stretch detackification adhesive tape to wrap predetermined portions of the stack of boxed items to provide lateral stability. Such a method should preferably use less material than other previous methods, and should easily secure the tape at strategic portions of the array—while being detackified at other locations so as to be releasable (i.e., the detackified tape should preferably be releasable such that it does not damage the surface to which it is applied).

SUMMARY OF THE INVENTION

The present invention provides a simple and reliable apparatus for dispensing and variably stretching a stretch detackification adhesive tape, the adhesive of which is disabled (i.e., detackified) when the tape is stretched.

In the preferred embodiment apparatus, a dispenser apparatus is provided which is comprised of a stretchable adhesive tape in roll form (i.e., the tape supply is provided in large rolls with the tape being wound upon itself with a tape core at the center) that is advanced from the supply through a stretching station to the array of boxed items. Tension rollers are utilized on either side of the stretching station to ensure that the tape advances evenly from the supply and does not recoil. The dispenser apparatus also includes a first prime mover which advances the tape through the tension rollers and stretching station at a rate which ensures proper stretching (at predetermined intervals) and proper feeding of the tape to the array of boxed items.

In the preferred embodiment, the stretching station is comprised of first and second stretching zones; although other numbers of stretching zones may be used depending upon the tape limitations, among other factors. For example, the preferred tape is not physically capable of being stretched longitudinally in a single stretch to the desired final stretch percentage. A "desired final stretch percentage" may be based on several factors, including the percentage of stretch required to deactivate the adhesive and whether that particular percentage stretch will result in the desired economy, vis-a-vis the amount of tape used to unitize a stack of articles versus the cost of the tape.

It is preferable that the minimum amount of tape is used in the unitizing process so as to reduce the costs associated with unitizing and to reduce the amount of material which must be recycled or placed in a landfill. It will be immediately appreciated that as the amount the tape is stretched is increased, the amount of tape that is used is decreased. However, at a certain point the stretching impairs the physical integrity of the tape backing. Although a stronger tape backing might be used, this would add to the cost of the tape. Therefore, these factors must be balanced against one another.

A second consideration is the speed at which the tape is stretched. It is preferable that the tape be stretched as quickly as possible in order to minimize the time required to unitize. However, the speed at which the tape is stretched must not exceed the physical limitations of the tape backing. Again, although a stronger tape backing might be used, this would add to the cost of the tape. Therefore, these factors must also be balanced against one another.

The dispenser apparatus is mounted on a z-axis platform which is driven by a second prime mover arranged and configured to move the z-axis platform vertically up and down relative to the array. The array of boxed items are typically placed on a pallet set on a turntable. Third prime mover means are provided to rotate the turntable.

As the turntable rotates about its axis, a controller device senses movement of the turntable via appropriate sensors. Therefore, reference points are established for the coordinated rotation of the turntable and the z-axis movement of the dispenser apparatus. By simultaneously controlling the z-axis motion (i.e., movement of the z-axis platform at a certain velocity in the z-axis direction) and controlling the rotation speed of the turntable, both the number of wraps about the array of boxed items and the location of the wraps between the base of the array and the top of the array may be controlled. The resulting motion provides a wrap pattern of tape about the array which unitizes the same.

Therefore, according to one aspect of the invention, there is provided an apparatus for unitizing a plurality of articles, comprising: (a) means for holding a supply of stretch detackification adhesive tape, the tape having a leading end, and wherein the adhesive of the tape is detackified when said tape is stretched, said detackification being defined as the adhesive of the tape being reduced to an approximate level where it does not damage the surface of the articles to which it is applied; (b) dispenser means including: (A) means for feeding the tape through said dispenser means from said supply of tape to an outlet; (B) means for stretching the tape, wherein the tape is detackified when stretched by said stretching means while retaining the structural integrity of the tape backing, whereby the tape may be delivered continuously to said output; and (c) wherein the tape may be wrapped about the articles upon movement of the tape about and vertically relative to the articles, whereby a unitizing pattern of the tape is created about the articles with predetermined portions of the wrap pattern including detackified tape.

According to another aspect of the invention, there is provided a unitizing apparatus comprising: (a) means for carrying an array of articles to be unitized; (b) supply means for carrying a supply of stretchable adhesive tape, the tape being of the type which-progressively detackifies when stretched; (c) stretching means, arranged and configured to threadably receive the tape from said dispenser means, for stretching the tape at predetermined intervals along its longitudinal axis, said stretching means including first and second tape translation means for translating the tape at disparate speeds at predetermined times, whereby the tape is selectively stretched between said first and second tape translation means; (d) means for creating relative rotation between said stretching means and said array carrying means, whereby the array to be taped rotates relative to said stretching means; and (e) elevation means, cooperatively connected to said stretching means, for elevating said stretching means in a predetermined manner relative to the array, wherein the tape is stretched prior to being applied about the array except at desired locations.

According to a further aspect of the invention, there is provided an apparatus as recited above, further comprising processor means for controlling said stretching means, said means for creating said relative rotation, and said elevation means in a predetermined manner.

According to still another aspect of the invention, there is provided an apparatus for unitizing a plurality of articles that are arranged in one or more tiers with a variable stretch dependant adhesive tape, comprising: (a) means for holding a supply of variable stretch dependant pressure-sensitive adhesive tape having (1) a backing having a Young's modulus of at least about 2500 psi but less than about 100,000 psi, a lengthwise elongation at break of at least about 150%, and low recovery, and (2) the backing bearing a layer of pressure-sensitive adhesive thereon, wherein the adhesive detackifies upon longitudinal elongation of the backing; (b) means for feeding the tape between said holding means and an outlet proximate the articles; (c) means for stretching the tape between said holding means and said outlet by entraining the tape over at least two tape engagement roller surfaces, wherein the tape is frictionally engaged and is stretched between said two surfaces when said surfaces move at a disparate speed relative to one another at predetermined times; and (d) wherein the tape may be applied to the articles in a unitizing pattern in either a stretched or unstretched state, while minimizing the amount of surface area of the articles which is covered by an adhesive.

While the invention will be described with respect to particular embodiments and with respect to particular components used therein, it will be understood that the invention is not to be construed as limited in any manner by either such configurations or components. Variations of the invention will become apparent to those skilled in the art upon a more detailed description of the invention.

These and various other advantages and features which characterize the invention are pointed out with particularity in the claims annexed hereto and forming a part hereof. However, for a better understanding of the invention, its advantages and objectives obtained by its use, reference should be made to the Drawing which forms a further part hereof and to the accompanying descriptive matter, in which there is illustrated and described a preferred embodiment of the invention.

DESCRIPTION OF THE DRAWING

Referring to the Drawing, wherein like numerals represent like parts throughout the several views:

FIG. 3 is a perspective view of the dispenser apparatus 40 of the unitizer system 20 of FIG. 1;

FIG. 4 is a top plan view of the dispenser apparatus 40 of FIG. 3 (with a first alternative embodiment illustrated in phantom);

DETAILED DESCRIPTION OF THE PREFERRED EMBODIMENT

As mentioned above, the principles of this invention apply to the unitizing of a plurality of articles/items which are typically placed in cardboard boxes, cartons, or other packaging material and are then stacked upon one another on a wooden pallet. By placing the items on a pallet, movement of a large number of boxes during warehousing, loading and shipping is facilitated (especially by means of a forklift or the like). More specifically, this invention provides for dispensing, while selectively and variably stretching, a variable stretch detackification adhesive tape about a stack/array of boxed items in order to provide lateral stability to the array. In this manner, the organization or pattern of the layers of boxed items may be devoted toward more efficient utilization of space and stronger vertical stability. Although "boxed items" will be used as the example herein, the invention is not so limited; and those skilled in the art will appreciate upon a review of this specification that other products, packages, bags, barrels, etc. may be unitized in accordance with the present invention. Further, although the specific example used herein includes a pallet, the invention is not so limited; and those skilled in the art will appreciate that the invention includes unitizing various articles whether or not such articles are placed upon a pallet.

By providing for an initial length of tape to remain unstretched and thereby retain its tack/adhesive, the tape may be readily secured to the stack of boxed items without cumbersome efforts to manually secure the tape, or to otherwise fasten or tuck the tape between items. Preferably, once the tape is secured, the dispenser apparatus portion of the unitizer system then stretches the tape while (a) the pallet is rotating and (b) the dispenser apparatus is elevated relative to the stack of boxed items. As the preferred tape is stretched along its longitudinal axis, the adhesive on the tape loses its adhesiveness (i.e. the adhesive is "detackified"); whereby the tape does not appreciably stick to the boxed items other than at unstretched, predetermined portions. The degree of adhesiveness of the tape is then preferably a matter of the variable selective stretching performed by the dispenser apparatus.

In order to facilitate a clearer understanding of the present invention, a detailed description of the dispenser apparatus (best seen in FIGS. 3, 4 and 5) will be deferred pending a discussion of the various components of unitizer system 20.

Unitizer System 20

Figure 1:
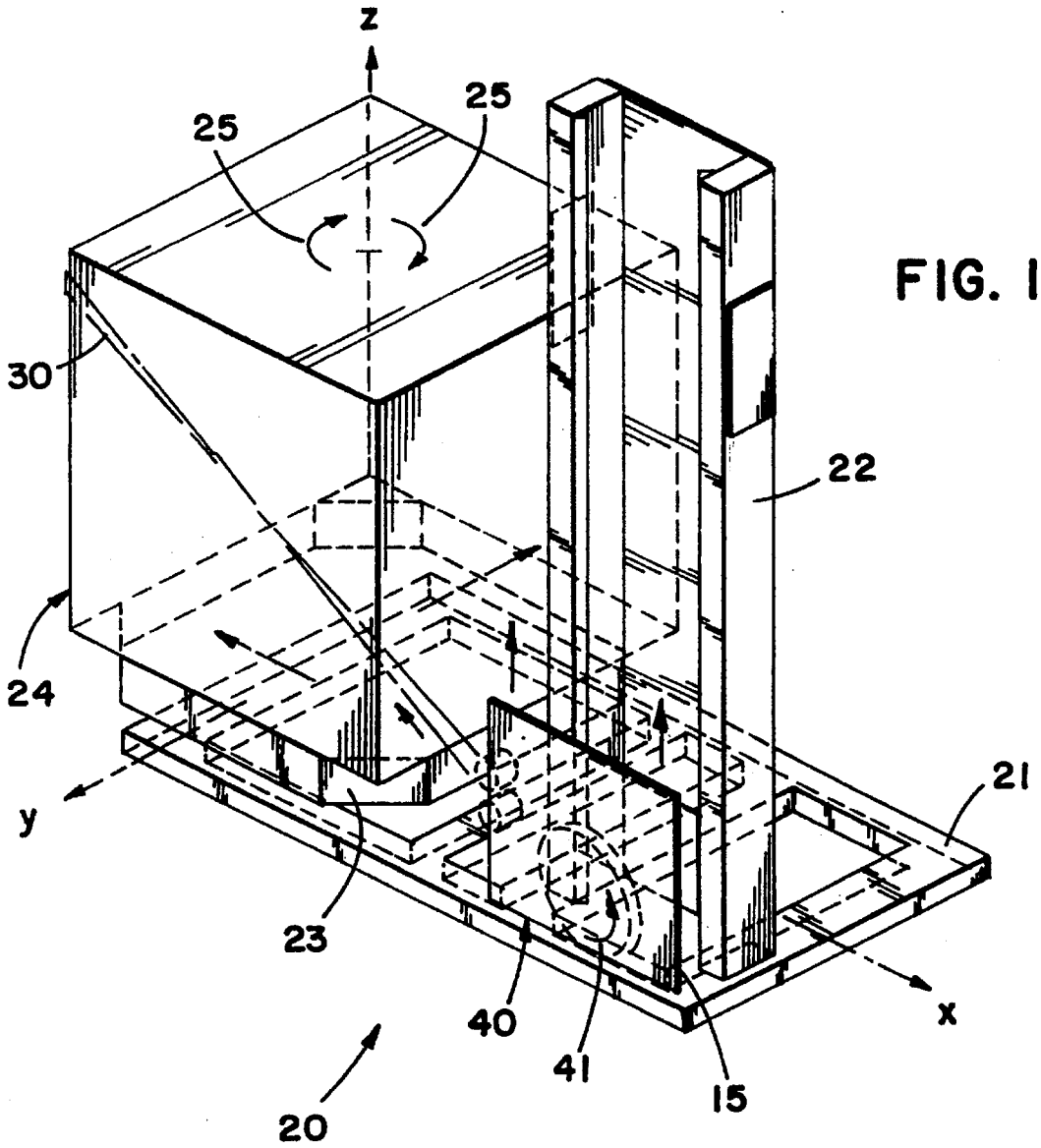
FIG. 1 is a perspective view of a preferred embodiment unitizing system 20 constructed according to the principles of the present invention.
Figure 2:
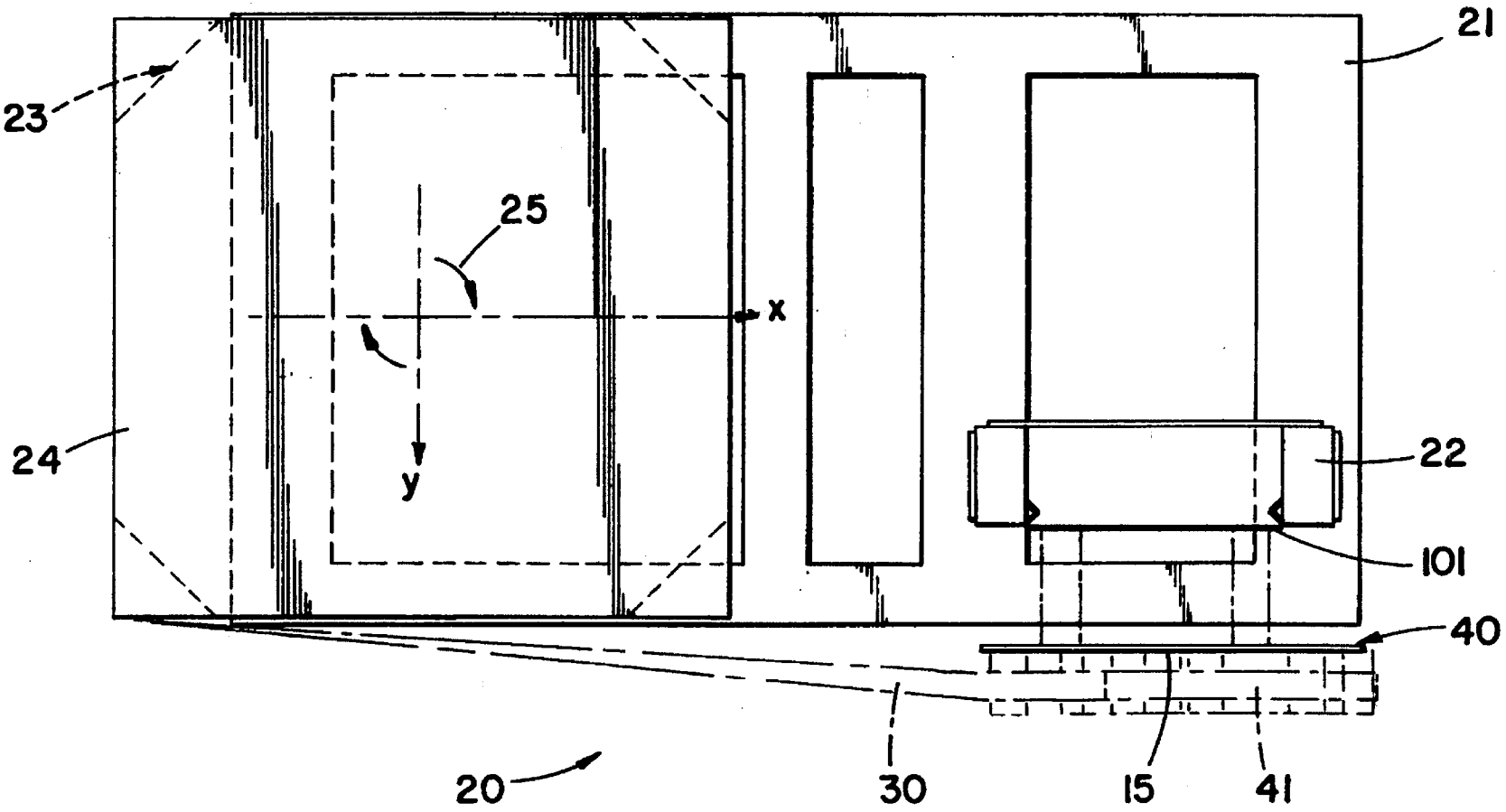
FIG. 2 is a top plan view of the unitizing system 20 of FIG. 1.

Referring first to FIGS. 1 and 2, there is generally illustrated a preferred embodiment unitizer system 20 constructed according to the principles of the present invention. The system 20 includes a base frame network 21, a vertical frame 22 (comprised of oppositely disposed vertical members cooperatively connected to base 21), and turntable 23. While not specifically detailed herein, it will be apparent to those skilled in the art that turntable 23 is rotatably mounted on base 21 by means of a shaft and appropriate bearings (not shown) to rotate in the direction illustrated by arrows 25.

For the purposes of aiding in the description of the system 20, a Cartesian coordinate system will be used which is comprised of an x-y plane taken horizontally through base 21, with the x-axis being parallel to the base 21 frame members which extend away from the vertical support members 22. The z-axis is normal to the x and y plane and centered on the axis of turntable 23. The coordinate system is best seen in FIG. 1. With the coordinate system now having been defined, it will be appreciated that the rotation of turntable 23 is about the z-axis, and that movement of the z-axis platform (discussed further below) relative to the array of boxed items entails vertical movement which may be defined in terms of a height along the z-axis above the x-y plane. Rotation about the z-axis is shown by arrow 25 in FIGS. 1 and 2.

Volume 24 denotes a plurality of boxed items stacked upon a pallet 16 (best seen in FIG. 8) to be unitized. As noted above, the volume 24 is comprised of an array l×m× n. The term "unitized" as used herein shall mean securing an array of objects comprising volume 24 together (i.e., the individual boxes are fixed to one another in the array). The term "palletized," as used herein, shall also be given its normal use in the art. However, briefly for the purpose of aiding in the understanding of the description of the present invention, the term "palletized" means placing a load of boxed items onto a pallet in order to facilitate shipment of the boxed items or movement of the boxed items within a warehousing operation.

Figure 6:
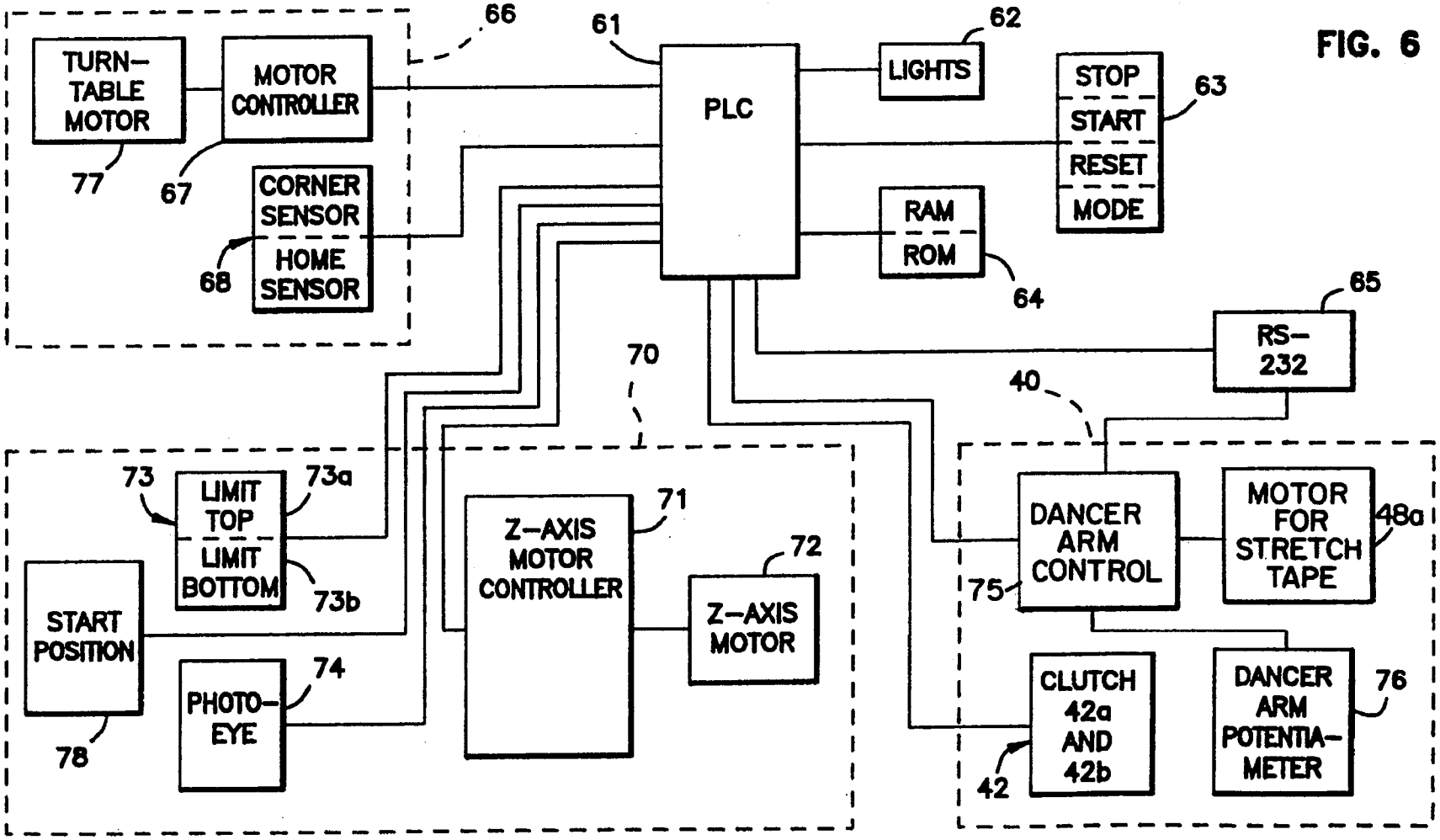
FIG. 6 is a schematic view of the functional blocks of the electronic components of the unitizer system 20 of FIG. 1.
Figure 10:
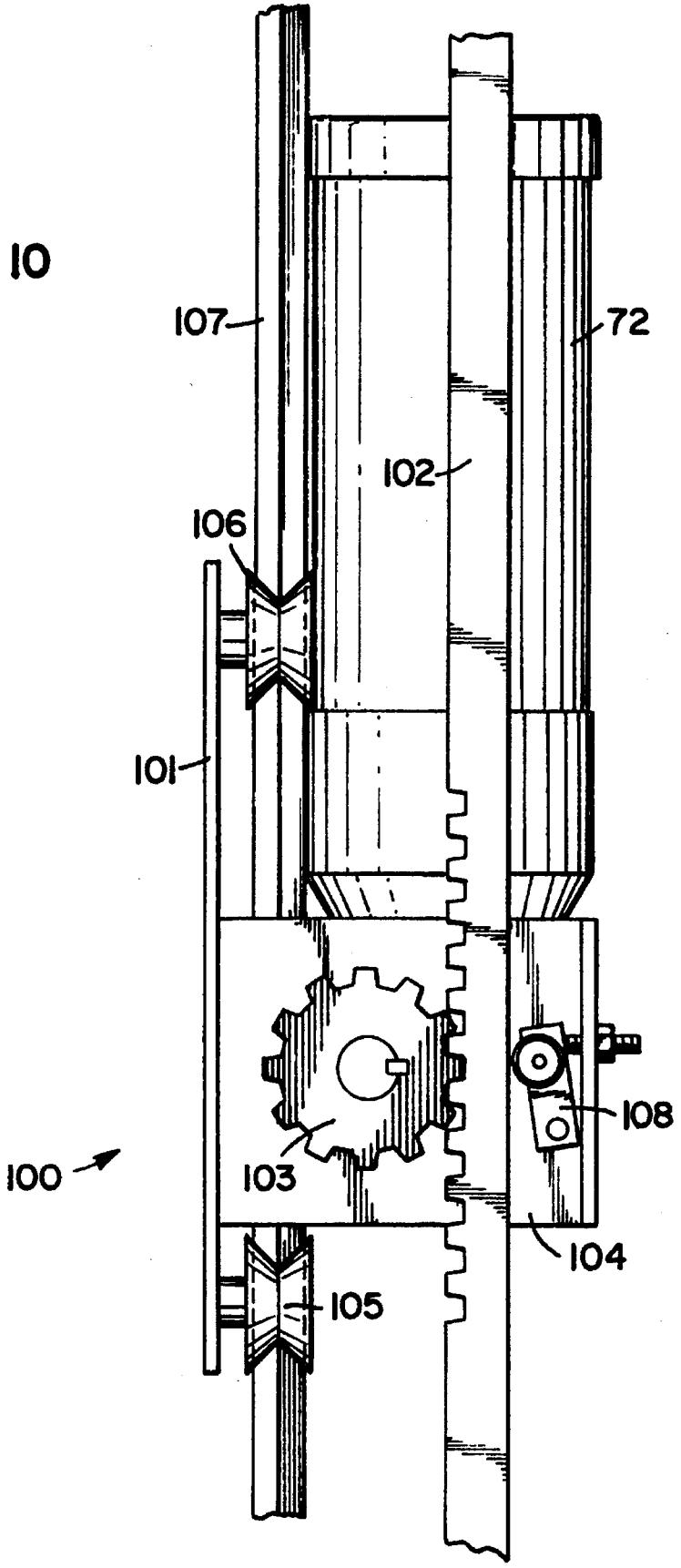
FIG. 10 is a preferred z-axis platform 100 of unitizer system 20 of FIG. 1.

Still referring to FIGS. 1 and 2, z-axis platform 100 (best seen in FIG. 10) is slidably connected to vertical support 22 and is moved up and down the vertical frame 22 via z-axis motor 72 (best seen in FIGS. 6 and 10). The z-axis platform 100 and the means to drive it up and down relative to vertical frame 22 (via motor 72) are well known in the art and so will not be described in great detail herein. FIG. 10 illustrates z-axis platform 100 which preferably includes a rack 102 and pinion gear 103 drive system. Cam follower 108 ensures that the rack 102 and pinion gear 103 remain properly mated. Z-axis motor 72 is connected to gear 103 via gear box 104. An angle iron track 107 is cooperatively engaged in the "V" of v-grooved wheels 105, 106, while adaptor plate 101 provides a base on which to secure standoffs 57 (discussed below).

Dispenser Apparatus 40

Cooperatively mounted on z-axis platform 100 is dispenser apparatus 40. The dispenser apparatus 40 preferably includes a supply of tape 41, electric clutches, and various tensioning and idler wheels (described below). Tape 30 is dispensed from dispenser apparatus 40 to the boxed items comprising volume 24 in a manner which will be further described below.

Dispenser apparatus 40 includes a mounting plate 15 which is oriented physically at a ninety degree (90°) angle with respect to the plane formed by the x, y axis. Due to this orientation, the tape 30 includes a 90° twist between the dispenser apparatus 40 and the volume 24. Such twist helps the tape 30 to resist kinking and "rolling over" when being applied to the boxed items of volume 24. Additionally, as the dispenser apparatus 40 moves vertically relative to the volume 24, the twist in the tape 30 enables the tape 30 to lie flat against the sides of the volume 24.

Dispenser apparatus mounting plate 15 is oriented parallel to the x-z plane and perpendicular to the y-z plane. This preferred orientation is determined to facilitate the tape 30 path from the dispenser apparatus 40 to the volume 24. Those skilled in the art will recognize that the perpendicular angle with respect to the plane formed by the y-z axis is illustrative only and that other angles might be utilized which facilitate the securing of the tape 30 against the sides of volume 24 in order to generally lay flat.

Figure 5:
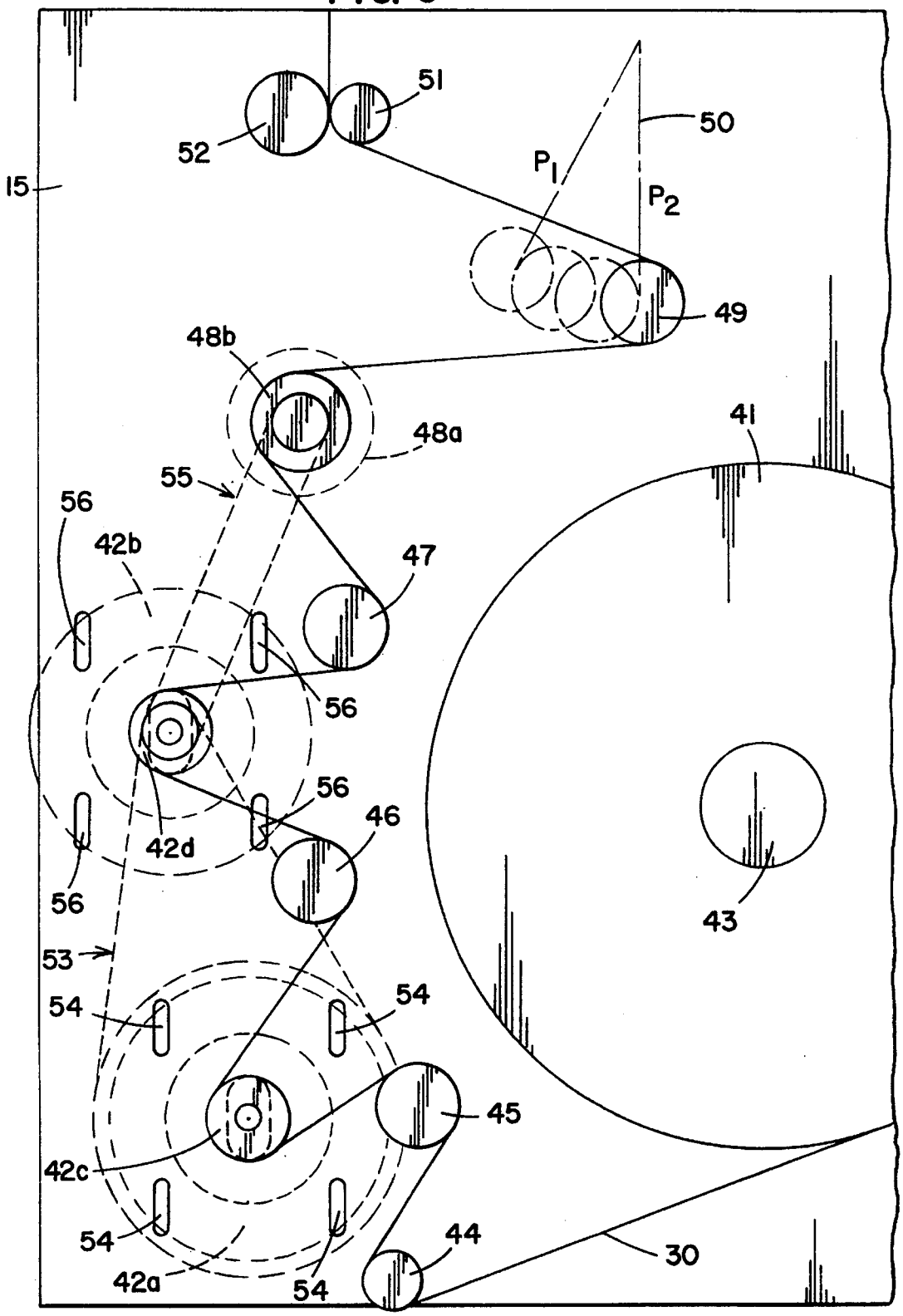
FIG. 5 is a diagrammatic front plan view of the dispenser apparatus 40 of FIG. 3.

Referring next to FIGS. 3, 4 and 5, there is illustrated a preferred tape dispenser apparatus 40. In the preferred embodiment, the tape 30 utilized is a roll of variable stretch/release tape which loses its tack/adhesiveness when stretched. Those skilled in the art will recognize that the preferred tape is stretched along the tape's 30 longitudinal axis (although a tape stretched in other manners might also be utilized). The preferred tape supply is illustrated at 41. A preferred tape 30 which has the characteristics of that described herein is manufactured by one of the assignees of the present invention, Minnesota Mining and Manufacturing Company of St. Paul, Minn., the specifications of such preferred tape 30 being described further below.

The tape supply is mounted on a friction brake type drum assembly 43. Those skilled in the art will appreciate that such a friction brake is preferably comprised of two washers with an adjustable compressed spring to provide drag. The tape 30 then sequentially travels through a first tensioning station, a stretching station, an automatic supply station, and a second tensioning station before proceeding to the volume 24. Each of the stations will next be described.

First, the tape 30 proceeds from the supply 41 to first tensioning station where it is wound around a shaft tension roller 44, comprised of a plastic knurled roller. Shaft tension roller 44 helps tension the tape 30 as it moves through the dispenser apparatus 40. Shaft tension roller 44 is preferably mounted on a needle bearing having a one way clutch. The tape 30 then continues about an idler wheel 45. Idler wheel 45 is comprised of a UHMW or Delrin covered wheel mounted on a needle bearing.

Second, the tape 30 proceeds to the stretching station where the tape 30 is wrapped about a silicone covered wheel **42*c* which is attached to a first electronic clutch assembly 42*a*. The first clutch assembly 42*a* selectively dictates whether the wheel 42*c* either freewheels or rotates at a fixed speed established by a timing chain driven gear attached to the wheel 42*c*. In effect, the first clutch assembly 42*a* either engages or disengages the wheel 42*c* to the chain driven gear, and accordingly has two operative states. The timing chain is illustrated at 53**.

Still proceeding with the preferred stretching station, tape 30 continues about a second idler wheel 46, a second wheel **42*d* connected to second electronic clutch assembly 42*b*, and a third idler wheel 47. Idler wheels 46 and 47 are similar to first idler wheel 45, while second electronic clutch 42*b* and silicone covered wheel 42*d* are similar to first electronic clutch 42*a* and wheel 42*c* respectively. In the preferred embodiment, the electronic clutches 42*a*, 42*b* utilized are manufactured by Warner Electric of South Beloit, Ill., having model designation 20/30 UNIMODELS (no base). Tape 30 then proceeds about first prime mover wheel 48*b* which is connected to a drive motor 48*a*** through a gear box (not shown).

The area between the first electronic clutch assembly **42*a* and the second electronic clutch assembly 42*b* comprises the first stretching zone. The area between the second electronic clutch assembly 42*b* and the first prime mover wheel 48*b*** comprises the second stretching zone.

Third, after passing through the stretching station, the tape 30 proceeds to the automatic supply station. Here the tape 30 is wound about dancer arm wheel 49 which is rotatably connected to a second end of dancer arm 50. The first end of dancer arm 50 is pivotably connected to plate 15. The dancer arm assembly 49, 50 provides an analog signal via potentiometer 76 to a dancer arm controller 75 (best seen in FIG. 6) driving first prime mover wheel **48*b*. In operation, when the free end of tape 30 is pulled, the dancer arm 50 is rotated toward position P1, the motor 48*a* is actuated, and tape 30 is pulled through the dispenser apparatus 40. The dancer arm assembly is then free to rotate toward position P2 (assuming the motor 48*a* is feeding the tape 30 through the system at a speed greater than the tape 30 is being pulled out of the dispenser apparatus 40**).

Finally, tape 30 proceeds to the second tensioning station after leaving dancer arm wheel 49. Second tensioning station is comprised of a second shaft tension roller 51 assembly which minimizes back lash of the tape 30 through the system. Pinch roller assembly 52 keeps the tape 30 in position against second shaft tension roller 51 upon cutting the tape 30.

To stretch the tape 30 longitudinally, it will be appreciated that the relative speeds of wheels **42*c*, 42*d* and 48*b* are varied. In the preferred embodiment, when the clutches are turned on to engage the wheels, the rotational speed of the wheels 42*c* and 42*d* are varied with respect to one another (wheels 42*c*, 42*d* are of similar circumference). More specifically, tape 30 is stretched in the first stretching zone since the second wheel 42*d* rotates faster than the first wheel 42*c*. Timing chain 53 controls the rotational speed via appropriately sized gears (not shown). Similarly, tape 30 is stretched in the second stretching zone due to the difference in rotational speed of wheels 42***d* and 48*b* (as controlled by chain 55 via appropriately sized gears). Those skilled in the art will appreciate that use of differently sized wheels rotating at the same rotational speed would also stretch tape 30 along its longitudinal axis.

Both clutches 42*a*, 42*b* are preferably turned on and off at the same time with the stretch in the first stretching zone between the clutches 42*a*, 42*b* being 6 to 1. The stretch in the second stretching zone between clutch 42*b* and tape drive motor wheel 48*b* is 1.167 to 1. Therefore, the tape 30 is stretched a total of approximately 7 to 1. Those skilled in the art, however, will recognize that the amount stretched is a function of design choice, so any variable clutch, or adjustable chain assembly between the clutches might be utilized.

As noted above, in the preferred embodiment, the stretching station is comprised of first and second stretching zones; although other numbers of stretching zones may be used depending upon the tape limitations, among other factors. For example, the preferred tape is not physically capable of being stretched longitudinally in a single stretch to the desired final stretch percentage. A "desired final stretch percentage" may be based on several factors, including the percentage of stretch required to deactivate the adhesive and whether that particular percentage stretch will result in the desired economy, vis-a-vis the amount of tape used to unitize a stack of articles versus the cost of the tape.

It is preferable that the minimum amount of tape is used in the unitizing process so as to reduce the costs associated with unitizing and to reduce the amount of material which must be recycled or placed in a landfill. It will be immediately appreciated that as the amount the tape is stretched is increased, the amount of tape that is used is decreased. However, at a certain point the stretching impairs the physical integrity of the tape backing. Although a stronger tape backing might be used, this would add to the cost of the tape. Therefore, these factors must be balanced against one another.

A second consideration is the speed at which the tape is stretched. It is preferable that the tape be stretched as quickly as possible in order to minimize the time required to unitize. However, the speed at which the tape is stretched must not exceed the physical limitations of the tape backing. Again, although a stronger tape backing might be used, this would add to the cost of the tape. Therefore, these factors must also be balanced against one another. In the preferred embodiment, the longest possible stretch was possible with the preferred tape using two stretching zones with the above described ratios. However, for example, a single stretching zone might be used if a different desired final stretch percentage was needed, or if a different tape was to be used.

As noted, chain 53 connects the two clutches 42 to establish the proper rotational speeds. In order to adjust the tension in chain 53, slotted mounting holes 54 are utilized. In order to drive clutch 42*b*, chain 55 is utilized. Therefore, the motor of first prime mover 48 drives clutch assembly 42*b* via chain 55, while chain 53 drives first clutch assembly 42*a*. To adjust the tension for chain 55, slotted holes 56 are provided.

Mounting standoffs 57 are used to connect plate 15 to plate 101 of the z-axis platform 100 (best seen in FIG. 4).

Controller and Electronics

Referring next to FIG. 6, the controller and electronics components of the unitizing system 20 are illustrated. Programmable Logic Controller 61 (PLC) lies at the heart of the controller and electronics of the unitizing system 20. In the preferred embodiment, a programmable module controller which is manufactured by Omron, of Japan, having a model designation C 28H is used.

However, it will be appreciated that other microprocessor devices having the capability of controlling motors, acting on stored instructions and receiving information via I/O devices might be utilized. Connected to PLC 61 are visual indication devices 62, typically lights or LED's, which indicate to an operator the status of the controller 61. The operator console (not shown) includes switches 63 to stop, start, reset, and to change the mode of the PLC 61. Random access memory 64 (RAM) and read only memory 64 (ROM) are used with PLC 61 to provide for storage of program instructions. Those skilled in the art will recognize that electrically erasable programmable read only memory such as EEPROM may be preferably utilized to facilitate storage and upgrading of such programs in the field. Additionally, an RS-232 port 65 may be provided for a hand held controller (not shown) and for testing of the apparatus.

PLC 61 is also cooperatively connected to the turntable electronics portion 66 which comprises motor controller 67, turntable motor 77 and sensors 68. Motor controller 67 (manufactured by Minark Controls of Glendale, Calif., having a model designation RG300U) receives signals sent by PLC 61 and controls a second prime mover 77 for rotating the turntable 23. Such controllers are well known in the art and so will not be described further herein. Preferably motor controller 67 is connected to the second prime mover 77 (preferably a DC motor) to provide rotation of the turntable 23 about the Z-axis. Two sensors 68 are mounted on base 21 and sensor triggering devices (not shown) are located on each corner of the turntable 23. Thus, a means to reference the status/orientation of the turntable 23 relative to the dispenser apparatus 40 is provided. While preferably sensors 68 are inductive proximity type sensors, they may either be reflective sensors or Hall effect switches, each of which are well known in the art. With the benefit of the information detected by such switches, PLC 61 is able to determine not only the number of rotations of the turntable 23, but also which corner of the turntable 23 is proceeding past the dispensing apparatus 40 at any given time (i.e., by counting the number of times that the corner sensors, actuated after the home sensor is actuated, it can be easily determined which corner is proceeding past the dispenser apparatus 40).

PLC 61 is also attached to the dispenser apparatus 40 components. More specifically, PLC 61 is connected to the clutches 42*a*, 42*b* and the stretch tape motor 48*a*. As those skilled in the art will recognize from the description above, when PLC 61 deactivates the clutches 42*a*, 42*b*, the clutches freewheel despite being connected to the drive chains 55, 53. When the clutches are freewheeling, the tape 30 moves about wheels 42*c*, 42*d* in a "free fashion" and is not stretched.

PLC 61 is also cooperatively connected to the z-axis platform electrical components 70. Z-axis platform components 70 include z-axis movement means comprised of a z-axis motor controller 71 cooperatively connected to a z-axis motor 72. Z-axis motor controller 71 is preferably of the same type as motor controller 67 discussed above. Also, to provide reference points for the Z-axis travel, limit switches 73 are provided, as well as a photoeye 74 and start position sensor 78.

The top limit switch 73*a* is provided in case the volume 24 is too high for the photoeye 74. The negative limit switch 73*b* is provided to establish a reference or home position for the dispenser apparatus 40.

The photoeye 74 travels up and down relative to the support members 22 on the z-axis platform to detect the presence of the items in volume 24. The photoeye sensor 74 looks for return light from an LED, and therefore establishes the top of the volume 24. In the preferred embodiment, the photoeye 74 is a diffuse type (model designation 42RLP) LED proximity control manufactured by Allen Bradley of Waltham, Mass.

Program Logic

Figure 7:
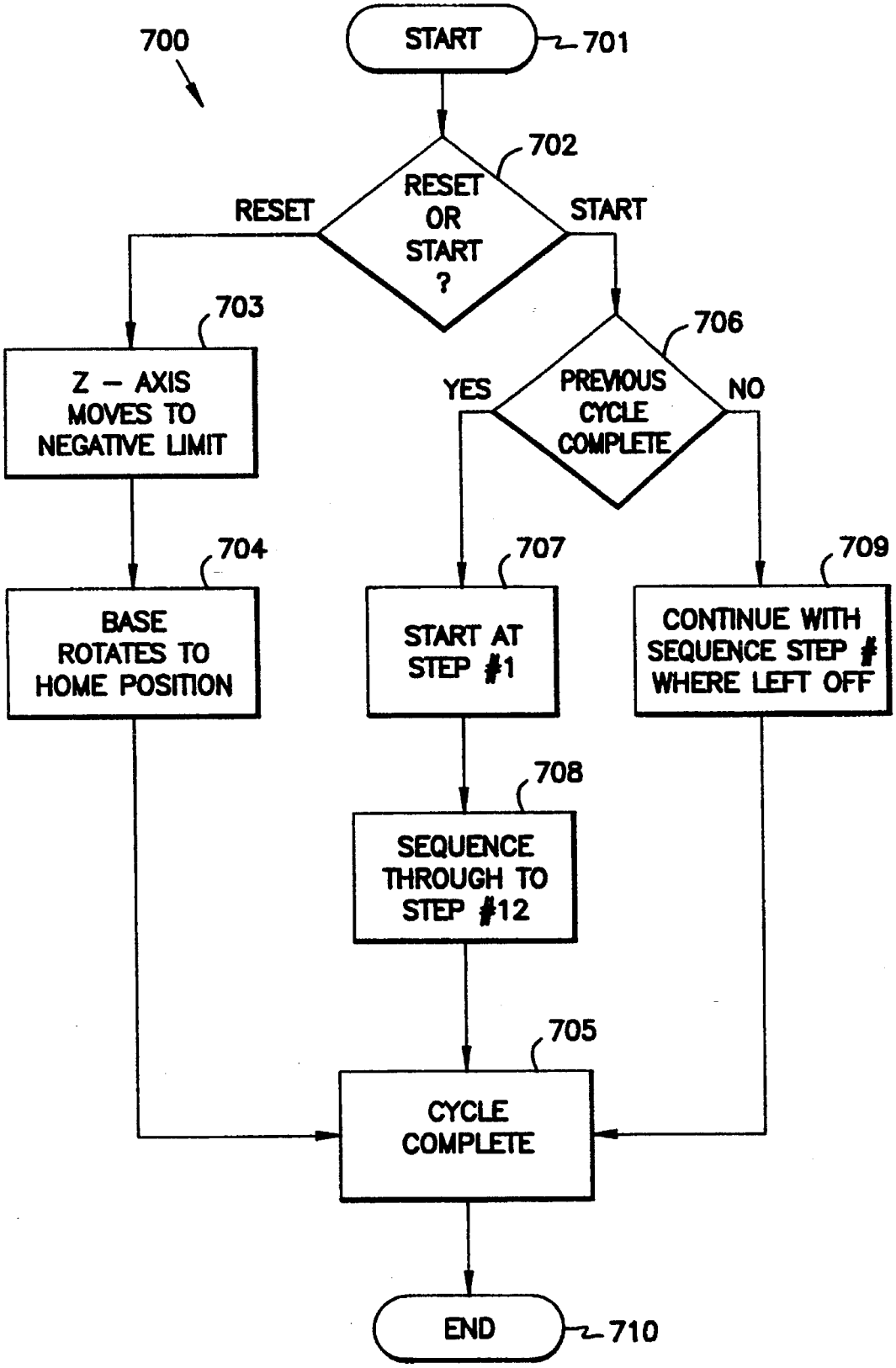
FIG. 7 is a logic block diagram illustrating computer program operation of block 61 of FIG. 6.

Referring next to FIG. 7, there is illustrated a logic flow diagram of an embodiment of the program logic which might be resident in PLC 61, wherein the logic diagram is generally shown at 700. Logic flow diagram 700 illustrates the steps taken to wrap the tape 30 about the stack of items 24 so as to unitize the stack.

Although PLC 61 will be characterized as "preceding" from logical block to logical block, while describing the operation of the program logic, those skilled in the art appreciate that programming steps are being acted on by PLC 61.

In operation, PLC 61 starts at block 701. The PLC 61 then proceeds to block 702 of logic flow diagram 700. At block 702, PLC 61 determines whether the reset or start switches 63 have been initiated. In event that the reset switch has been activated, the Z-axis motor controller 71 is initialized to activate the motor 72 thereby moving the dispenser apparatus 40 to its negative vertical limit (i.e., the lowest allowable point of travel of the z-axis platform relative to the z-axis) which is determined by negative limit switch 73*b*. Further, the turntable 23 is then rotated to its home position as determined by sensors 68*a*, 68*b*. Rotation of the turntable 23 is achieved via motor controller 67 and motor 77 rotating the turntable 23 about its axis. The reset cycle is then complete at block 705.

If it is the start switch which has been activated at block 702, PLC 61 proceeds to block 706 where PLC 61 determines whether the previous cycle was completed or interrupted. In the event that the previous cycle was completed, PLC 61 starts at step number 1, to be described next, at block 707.

The following table sets forth the correlation between step numbers as described herein and the action taken by PLC 61 to coordinate the rotation, the activation of the clutches 42*a*, 42*b*, and the movement of the dispenser apparatus 40 relative to the volume 24 to wrap the tape 30 about volume 24 and to achieve the desired pattern. The step numbers are merely illustrative.

TABLE I

| STEP NUMBER TO ACTION NUMBER CONVERSION TABLE | |
|---|---|
| STEP 1 | ACTION #1 |
| STEP 2 | ACTION #2 |
| STEP 3 | ACTION #3 |
| STEP 4 | ACTION #2 |
| STEP 5 | ACTION #4 |
| STEP 6 | ACTION #3 |
| STEP 7 | ACTION #1 |
| STEP 8 | ACTION #2 |
| STEP 9 | ACTION #3 |
| STEP 10 | ACTION #2 |
| STEP 11 | ACTION #3 |

TABLE I-continued

| STEP NUMBER TO ACTION NUMBER CONVERSION TABLE | |
|---|---|
| STEP 12 | ACTION #5 |

As noted, the foregoing table is illustrative of a sample winding type pattern, and those skilled in the art will recognize that numerous styles of patterns may be achieved through various programming steps and activation by PLC 61 through mode change buttons 63*d*.

The definition of the various actions set forth in Table I are next set forth in Table II.

TABLE II

| ACTION DEFINITIONS | |
|---|---|
| ACTION #1 | STRETCH TAPE 30 ACROSS ONE FACE OF VOLUME 24, DO NOT MOVE UP/DOWN |
| ACTION #2 | STRETCH TAPE 30 ACROSS THREE FACES OF VOLUME 24 WHILE MOVING TO TOP WHILE Z AXIS IS SET TO CERTAIN SPEED (MATCHED TO SPEED OF TURNTABLE 23) |
| ACTION #3 | STRETCH TAPE 30 ACROSS THREE FACES OF VOLUME 24 WHILE MOVING TO BOTTOM WHILE Z-AXIS IS SET TO CERTAIN SPEED (MATCHED TO SPEED OF TURNTABLE 23) |
| ACTION #4 | STRETCH TAPE 30 ACROSS FOUR FACES OF VOLUME 24. DO NOT MOVE UP/DOWN |
| ACTION #5 | STRETCH TAPE 30 ACROSS ONE FACE OF VOLUME 24, THEN RELEASE STRETCH MECHANISM (I.E., DEACTIVATE CLUTCHES) AND WRAP TAPE 30 AROUND ONE MORE FACE OF VOLUME 24. |

Figure 8:
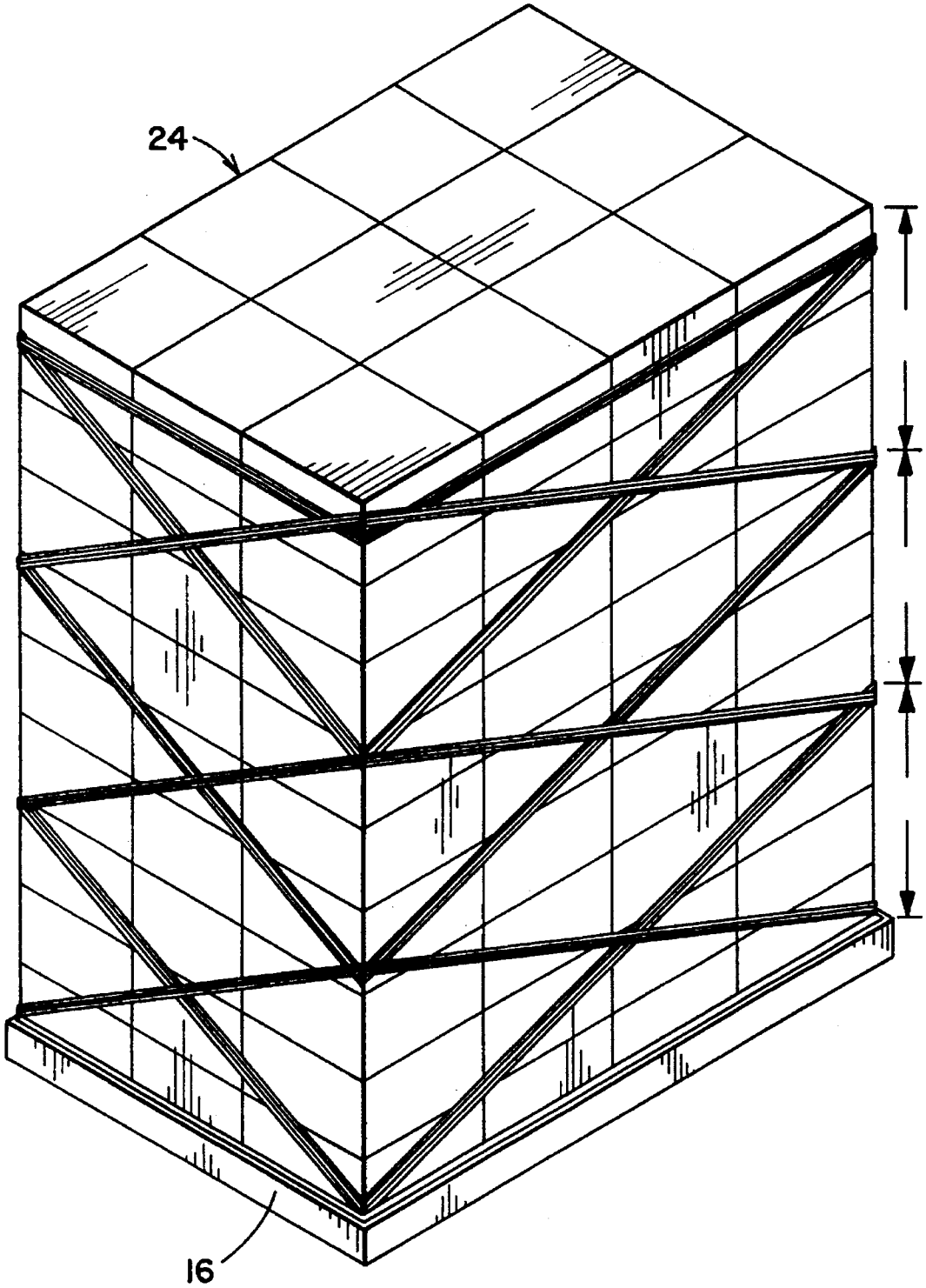
FIG. 8 illustrates an example of a wrapping pattern which may be generated by unitizer system 20 about a stack/array of boxed items 24 of FIG. 1.

The Action Definitions are illustrative and should not be construed as limiting. Those skilled in the art will appreciate that to perform the sample pattern set forth in Table I above, as PLC 61 progresses through each step, a different Action is performed by the unitizer system 20, wherein the various actions are defined in Table 2. An example of a resulting pattern is illustrated in FIG. 8. Referring once again to FIG. 7, PLC 61 sequences through the various steps set forth in Table I at block 708. Subsequent to completion of all steps, the cycle is complete at block 705.

If the previous cycle had been interrupted rather than completed at block 706, PLC 61 joins the interrupted sequence at block 709 completing the steps which were not completed. PLC 61 then proceeds to block 705 where the cycle is complete and ends at block 710.

While not specifically detailed in the figures herein, it will be well understood by those skilled in the art that the various components, microprocessors, and controllers, are to be properly connected to appropriate bias and reference supplies so as to operate in their intended manner. Similarly, it will be understood that appropriate memory, buffer and other intended and necessary peripheral devices are to be properly connected to PLC 61 so as to operate in its intended manner.

Tape 30

Figure 12A:
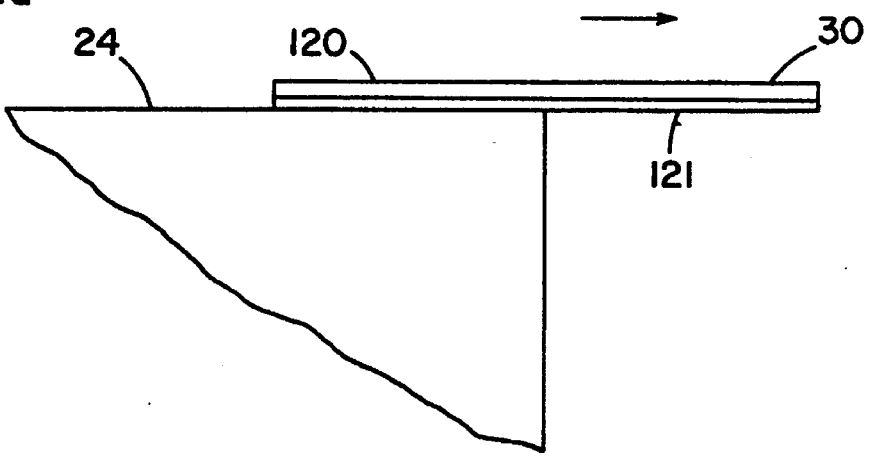
FIGS. 12*a*, 12*b* and 12*c* are enlarged side elevational views of a segment of tape 30 being placed about a corner of volume 24.
Figure 12B:
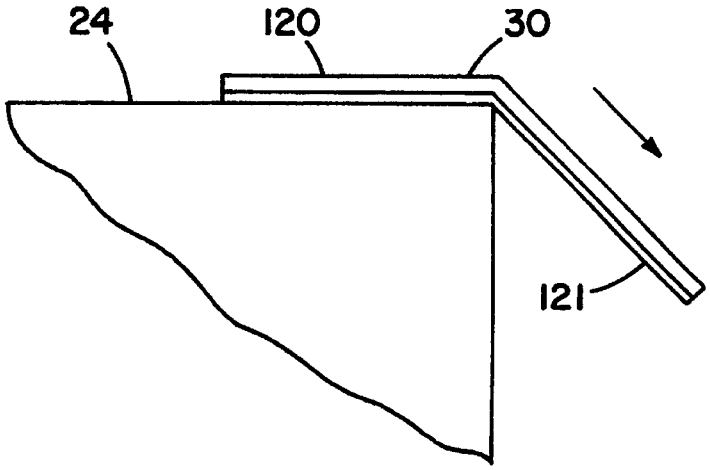
Figure 12C:
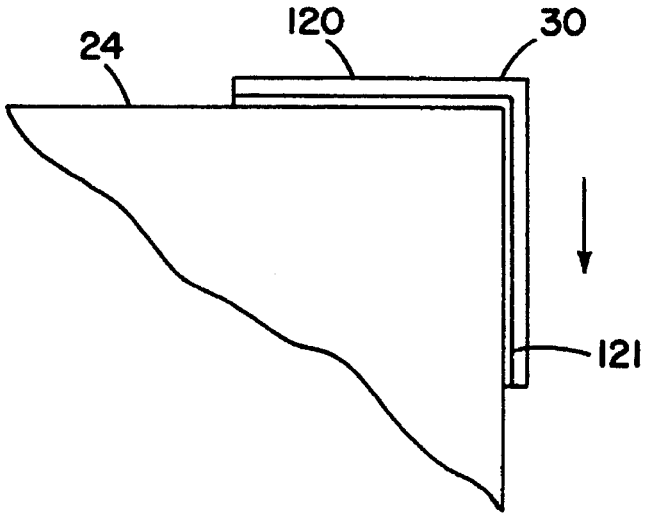

Referring to FIGS. 12*a*, 12*b* and 12*c*, there is illustrated a segment of tape 30 being placed about a corner of volume 24. It is preferable that an unstretched portion of the tape 30 is placed on a corner so that the adhesive 121 of the tape 30 has not been detackified (best seen in FIG. 12*a*). In FIG. 12*b*, the volume 24 is then rotated relative to the tape supply (not shown) and a portion of stretched or detackified tape 30 is thereby moved around the corner of the volume 24. As the relative rotation increases, the tape 30 is brought closer to the volume until in FIG. 12*c*, the tape 30 is applied to the adjacent face of the volume 24. By applying the tape 30 in this manner, the tape 30 is secured at the leading edge and is less likely to be pulled away from the surface to which it is applied.

In general, tape 30 comprises a backing 120 bearing on at least one major surface thereof a layer 121 of pressure-sensitive adhesive. The major surface of the backing not bearing the layer of pressure-sensitive adhesive can optionally bear a layer of low-adhesion backsize composition.

Materials suitable for the backing of the tape useful in this invention include highly extensible polymeric sheet materials having (1) a high tensile strength; (2) a lengthwise elongation at break of from about 50 to about 1,500%, preferably from about 150 to about 800%, more preferably from about 200 to about 800%, still more preferably from about 600 to about 800%; (3) substantial inelasticity, e.g., preferably having less than about 50% elastic recovery after being stretched, more preferably less than about 30% elastic recovery, still more preferably less than about 20% elastic recovery; and (4) a Young's modulus of at least about 2,500 psi, preferably at least about 3,000 psi, but less than about 100,000 psi, more preferably between about 5,000 and about 30,000 psi. A suitable method for measuring the Young's modulus of a material is described in ASTM Designation D882-88, Standard Test Methods for Tensile Properties of Thin Plastic Sheeting. If the Young's modulus is too low, the tape loses its plastic character and becomes rubbery.

Representative examples of materials suitable for the backing of the tape of this invention include polyolefins, such as polyethylene, including high density polyethylene, low density polyethylene, linear low density polyethylene, and linear ultra low density polyethylene, polypropylene, and polybutylenes; vinyl copolymers, such as polyvinyl chlorides, both plasticized and unplasticized, and polyvinyl acetates; olefinic copolymers, such as ethylene/methacrylate copolymers, ethylene/vinyl acetate copolymers, acrylonitrile/butadiene/styrene copolymers, and ethylene/propylene copolymers; acrylic polymers and copolymers; and combinations of the foregoing. Mixtures or blends of any plastic or plastic and elastomeric materials such as polypropylene/polyethylene, polyurethane/polyolefin, polyurethane/polycarbonate, polyurethane/polyester, can also be used. Backings are typically in the form of single or multi-layer films. Backings are preferably selected from polyethylene and polypropylene films, with the most preferred materials being linear low density and ultra low density polyethylene films.

Backings can be made by any known method of film forming, such as, for example, extrusion, co-extrusion, solvent casting, foaming, non-woven technology, and the like. The backing can have any thickness so long as it possesses sufficient integrity to be processable and handleable, with thicknesses preferably ranging from about 10 micrometers to 750 micrometers. Backings having thicknesses lower than about 10 micrometers are not preferred for aggressive adhesives. Backings having thicknesses higher than about 750 micrometers tend to require stretching forces that are higher than desired, thereby making applications more difficult, except by power driven machinery.

The adhesive of the adhesive layer can comprise any pressure-sensitive adhesive, with the particular adhesion properties being dependent on the use of the tape, with the preferred adhesion properties generally ranging from about 4 N/dm to about 200 N/dm, preferably from about 25 N/dm to about 100 N/dm, at a peel angle of 180°, measured according to PSTC-1 and PSTC-3 and ASTM Designation D903-83 at a peel rate of 12.7 cm/min.

Pressure-sensitive adhesives suitable for this invention include tackified rubber adhesives, such as natural rubber, olefins, silicones, polyisoprene, polybutadiene, polyurethanes, styrene-isoprene-styrene and styrene-butadiene-styrene block copolymers, and other elastomers; and tackified or untackified acrylic adhesives such as copolymers of isooctylacrylate and acrylic acid, which can be polymerized by radiation, solution, suspension, or emulsion techniques. The most preferred adhesives are tackified block copolymers. For some purposes, adhesives that are incapable of providing enhanced adhesion over time are desired, so that removal of the tape by peeling at a less than optimum angle will not excessively deface the package.

The thickness of the adhesive layer can range from about 15 micrometers to about 1,000 micrometers, preferably from about 25 micrometers to about 400 micrometers. In this preferred range of thicknesses, the thicker layers will detackify less than will thinner layers. Alternatively, the coating weight of the adhesive in the adhesive layer can range from about ½ grain/24 sq. in. to about 50 grains/24 sq. in., preferably from 3 grains/24 sq.in. to 15 grains/24 sq. in.

As the tape is stretched, the adhesive must detackify. As used herein, the term "detackification" means reduction of tack and adhesion. As a practical matter, upon stretching, tack is preferably reduced by at least 10%, more preferably by at least 25%, and even more preferably by at least 50%. However, for the purposes of unitizing, the tape 30 should be detackified to a level wherein it does not destroy or damage the surface to which it is applied.

It is believed that the adhesive detackifies because the coating weight of the adhesive layer decreases on account of the increased area of the surface of the backing. Surprisingly, the level of detackification exceeds what would have been expected merely from a decrease in coating weight per unit area. It will be appreciated that the preferred tape described herein exhibits a "progressive" detackification as the tape 30 is stretched. However, the invention might also clearly be used with a tape which exhibits a "step function" type of detackification—although it is not believed that such a tape currently exists.

The tape 30 of this invention can be produced by any conventional method for preparing pressure-sensitive adhesive tapes. For example, the adhesive can either be directly coated onto the backing, or it can be formed as a separate layer and then later laminated to the backing. In some cases, in order to improve adhesion of the adhesive layer to the backing, the backing can be pretreated prior to the coating step or the laminating step in one or more of the following ways: corona discharge, plasma discharge, flame treatment, electron beam irradiation, ultraviolet radiation, acid etching, or chemical priming. Such pretreatments can be carried out with or without reactive chemical adhesion promoters such as hydroxyethyl acrylate or hydroxyethyl methacrylate, or other reactive species of low molecular weight. Corona discharge pretreatment is generally preferred if a polymeric film backing is used.

In Operation

Those skilled in the art will recognize that in the operation of unitizer 20, an operator first selects the mode via button 63*d*. Then, the operator activates the reset switch 63*c* to initialize the unitizer. The z-axis controller 71 moves the dispenser apparatus 40 upward until the reset switch 63*c* is released, at which time the dispenser apparatus 40 travels downward to a start position (start position sensor 78 generates a signal, which is received by PLC 61, when the desired start position is reached). Additionally, as noted above, turntable 23 rotates to the home sensor 68*b*.

The palletized boxes comprising volume 24 is placed on the turntable 23 and the tape 30 is stretched from the dispenser 40 and stuck to the lower corner of the boxes (see FIG. 8 and 12*a*). By pulling the tape 30 manually, the dancer arm assembly turns the second prime mover motor 48*a* on in order to release the tape 30 (as noted above, a dancer arm spring normally biases the arm into the off position which keeps the motor 48*a* turned off). Additionally, the clutches 42*a*, 42*b* are normally off/released and therefore, by manually pulling the tape 30 an unstretched portion of tape 30 is released.

The operator then presses the start button 63*b* which causes the PLC 61 to activate the steps as described above. PLC 61 notes the corners of the stack 24 by looking for the rising edge signals generated by the interaction of the sensor operators with the sensors 68.

The dispenser apparatus 40 travels upward until either the photoeye 74 or upward limit switch 73 trips, or, may be programmed to travel upward until the turntable 23 rotates a certain number of revolutions, which may be determined by corner pulses generated by sensor 68 or may be determined by feedback from the prime mover 77 rotating the turntable.

The z-axis downward travel is arrested when negative limit switch 73*b* is tripped or, may be programmed to travel downward at a given rate until a predetermined number of pulses from the sensors 68 are received. After the desired wrap pattern is generated, the turntable 23 stops and the tape stretch is released. This provides a portion of adhesive tape 30 which may then be stuck to the boxes to complete the wrapping of the stack 24.

While in the preferred embodiment, there is no positive feedback on the Z-axis, positive feedback control of the Z-axis motor 72 may be utilized in lieu of the purely speed/time positioning method utilized in connection with photoeye 74 and limit switches 73.

Further, while the tape 30 is illustrated in FIG. 5 as being wrapped around 90° to 120° of wheels 42*c* and 42*d* to stretch the tape 30, only 90° is used in the preferred embodiment to actually stretch the tape 30. It should also be noted that the adhesive side of the tape 30 is placed against the stretching rollers.

First Alternative Embodiment

Next referring to FIG. 4, there is illustrated a first alternative embodiment unitizing device 20, wherein a second dispenser 40' is illustrated in phantom. Accordingly, in the first alternative embodiment there is provided second supply of tape 30' which enables wrapping the volume 24 in approximately half the time. This is accomplished by starting the tape 30' halfway up volume 24 and wrapping in a pattern such as that discussed above. A positioning roller (not shown) mounted on an arm (not shown) attached to plate 15 positions the tape 30' at the proper height with respect to the Z-axis. By overlapping the two tapes 30, 30' slightly, the volume is unitized securely. Each of the various components of dispenser apparatus 40' are provided in the first alternative embodiment. Each of the components have extended shafts with wheels cooperatively attached thereto so as to facilitate the second supply of tape 30' to travel concurrently through the similar components as first tape supply 30.

Second Alternative Embodiment

Figure 11:
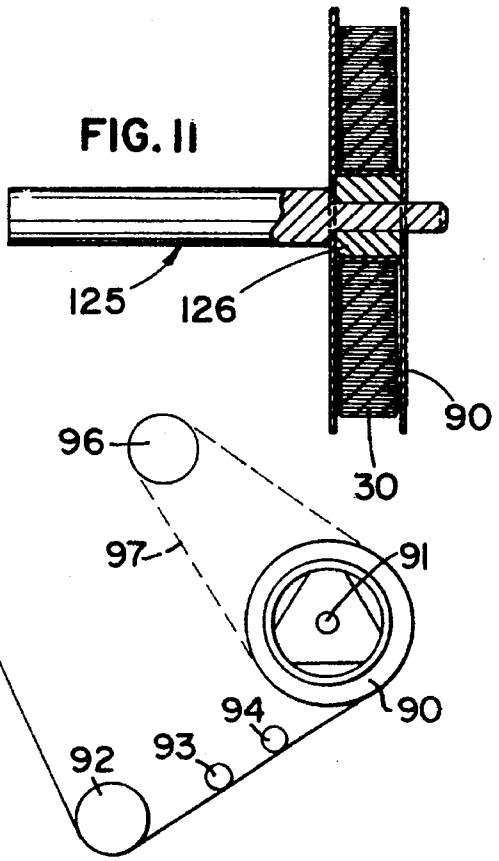
FIG. 11 is a side elevational view, with portions broken away to reveal the cross-section, of a hand-held device which holds the reel 90 of FIG. 9.
Figure 9:
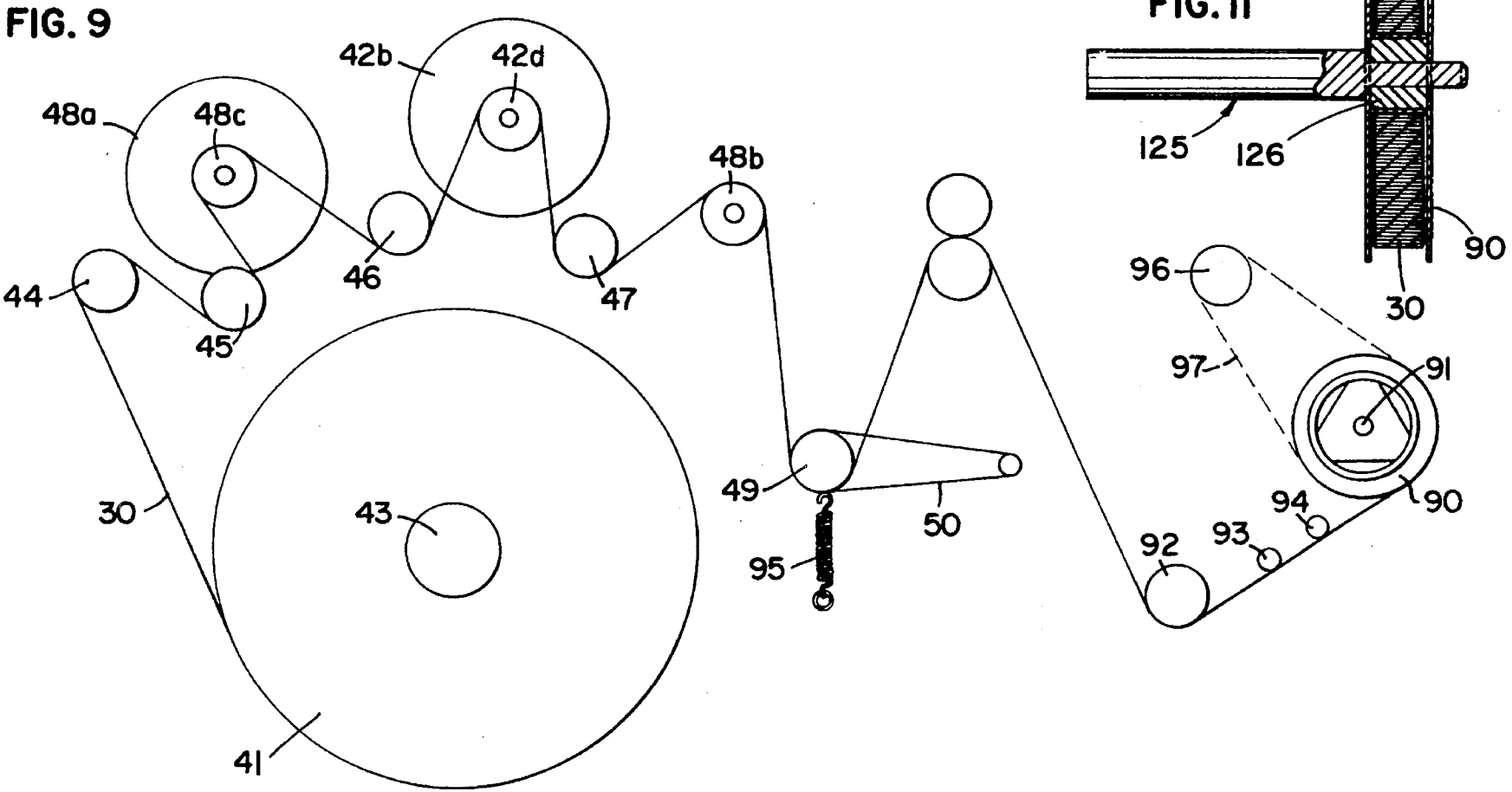
FIG. 9 is a second alternative embodiment stretch dispenser 40.

Next referring to FIG. 9, there is illustrated a second alternative embodiment of the unitizer device 20. In the second alternative embodiment, a hand-held take-up reel 90, is provided to take up the stretched and unstretched tape 30 from dispenser apparatus 40. The take-up reel 90 is removably mounted on a spindle 91 proximate the dispenser apparatus 40. A motor (not shown) drives the spindle 91 and the take-up reel 90 to wind the tape 30 onto the reel 90. A counter, or other well known means, is used to determine the amount of tape 30 wound onto the reel 90. Therefore, an operator may program the dispenser apparatus 40 (i.e., program the PLC 61) for a given array 24 of l×m× n boxed items of a certain dimension, wherein the proper length of stretched and unstretched tape 30 is wound onto the reel 90. The operator then removes the reel 90, placing the reel 90 onto a hand held device 125 (best seen in FIG. 11), and manually "walks" the reel 90 about the volume 24 while simultaneously providing the vertical movements with respect to the z-axis so as to unitize the volume 24. Those skilled in the art will appreciate that the hand held device 125 may include an optional one-way clutch mechanism 126 to further facilitate the correct application of the tape 30 to the volume 24.

In the second alternative embodiment, each of the various components of dispenser apparatus 40 may be utilized as those described above. In FIG. 9 the dancer arm 50 is illustrated as having a spring 95 to bias the arm in position. Since the motor 96 drives the spindle 91 via chain 97 pulling the tape 30 through the system, motor 48*a* becomes optional. Idler wheels 92, 93 and 94 are provided to keep the tape 30 in proper position during winding.

It will be appreciated that the principles of this invention apply not only to the unitizing of boxes described to implement the invention, but also to the apparatus in general of dispensing an adhesive tape. While a particular embodiment of the invention has been described with respect to its application for dispensing tape in a unitizing environment, it will be understood by those skilled in the art that the invention is not limited to such application or embodiment or to the particular dispenser device described herein. It will be appreciated by those skilled in the art that other dispenser devices and controllers that embody the principles of this invention and other applications therefor other than as described herein can be configured within the spirit and intent of this invention. The dispenser, controller, and adhesive tape described herein are provided only as an example of one embodiment that incorporates and practices the principles of this invention. Other modifications and alterations are well within the knowledge of those skilled in the art and are to be included within the broad scope of the appended claims.

What is claimed is:

1. An apparatus for unitizing a plurality of articles, comprising:

(a) means for holding a supply of stretch detackification adhesive tape, the tape having a leading end, and wherein the adhesive of the tape is detackified when said tape is stretched, said detackification being defined as the adhesive of the tape being reduced to an approximate level where it does not damage the surface of the articles to which it is applied;

(b) dispenser means including:

(1) means for feeding the tape through said dispenser means from said supply of tape to an outlet;

(2) means for stretching the tape by applying a stretching force to the tape, wherein the tape is detackified when stretched by said stretching means while retaining the structural integrity of the tape backing, whereby the tape may be delivered continuously to said output;

(3) a controller device for providing a control signal to said stretching means, wherein said stretching means is selectively activated to detackify the tape at predetermined intervals from the leading end of the tape in response to said control signal; and (4) means for adhering the tape to the articles by reducing the stretching force applied on the tape by said stretching means, wherein the tape may be wrapped about the articles upon movement of the tape about and vertically relative to the articles such that the tape is selectively adhered to the articles except at portions detackified by said stretching means, whereby a unitizing pattern of the tape is created about the articles with predetermined portions of the wrap pattern including detackified tape.

2. The apparatus of claim 1, wherein said stretching means includes a first stretching zone having first and second tape engagement surfaces which frictionally engage the tape, which move at disparate speeds relative to one another to stretch the tape, and wherein the tape is not stretched between said stretching means and said holding means.

3. The apparatus of claim 2, wherein said first and second tape engagement surfaces are curvilinear.

4. The apparatus of claim 3, wherein said first and second tape engagement surfaces are circular, are of approximately equal diameter, and which rotate at differing speeds when the tape is being stretched.

5. The apparatus of claim 3, wherein said first and second tape engagement surfaces are circular, are of differing diameter, and which rotate at approximately equal speeds when the tape is being stretched.

6. The apparatus of claim 2, wherein said stretching means includes a second stretching zone which is located between said outlet and said first stretching zone, said second stretching zone stretching the tape to a desired final stretch percentage, wherein the tape is stretched by different percentages in said first stretching zone and said second stretching zone, and wherein said first and second tape engagement surfaces are cooperatively connected to said selective activations means so as to be selectively powered to stretch the tape or free wheeling to allow the tape to remain unstretched.

7. The apparatus of claim 1, further comprising:

(a) turntable means for rotating the plurality of articles to be unitized; and (b) vertical movement means, cooperatively connected to said dispenser means, for moving said dispenser apparatus vertically relative to the articles.

8. The apparatus of claim 7, wherein said controller device is operatively connected to said turntable means and said vertical movement means for coordinating the rotation of the articles and vertical movement of said dispenser means, wherein predetermined patterns may be automatically formed by the tape to unitize the articles.

9. The apparatus of claim 8, wherein said controller device further includes first sensor means for determining the vertical height of said dispenser apparatus relative to the articles and second sensor means for determining the location of the articles on said turntable means.

10. The apparatus of claim 2, wherein said stretching means includes a first clutch and a second clutch each having shafts operatively connected to said first and second tape engagement surfaces respectively, wherein said first and second tape engagement surfaces freewheel when said clutches are in a first state, and said wheels are constrained to move at disparate speeds when said clutches are in a second state.

11. The apparatus of claim 10, wherein said controller device is operatively connected to said clutches so as to shift said clutches between said first and second states.

12. The apparatus of claim 1, wherein said dispenser means is oriented such that said leading end of the tape requires an approximately ninety (90) degree twist from said outlet to lie flat against the surface of the articles to be unitized, whereby the tape tends to lie flat and resist folding over on itself when applied to the articles.

13. The apparatus of claim 1, wherein stretched portions of the tape are stretched to a final ratio of about 7:1 by said stretching means.

14. The apparatus of claim 2, wherein stretched portions of the tape are stretched to a ratio of about 6:1 by said first stretching zone and to a ratio of about 1.167:1 by said second stretching zone, wherein a final stretching ratio of about 7:1 results.

15. The apparatus of claim 1, further comprising:

(a) second tape holding means for holding a second supply of stretch detackification adhesive tape, the second tape having a leading end, and wherein the adhesive of the second tape is detackified when the second tape is stretched;

(b) second dispenser means including:

(A) second feeding means for feeding the second tape through said dispenser means from said second supply of tape to an outlet;

(B) second stretching means for stretching the second tape, wherein the second tape is detackified when stretched by said second stretching means while retaining the structural integrity of the second tape backing, whereby the second tape may be delivered continuously to said output; and (c) wherein the second tape may be wrapped about the articles upon movement of the second tape about and vertically relative to the articles, whereby a unitizing pattern of the second tape is created about the articles with predetermined portions of the wrap pattern including detackified tape.

16. The apparatus of claim 15, wherein the second tape is wrapped at an elevation on the articles which is higher than the elevation on the articles at which the first tape is wrapped, whereby the articles can be wrapped more quickly.

17. The apparatus of claim 1, further comprising a take-up reel located proximate said outlet, said take-up reel having prime mover means for rotating said take-up reel, wherein predetermined lengths of stretched and unstretched tape may be wound upon said take-up reel for later manual application to unitize the articles.

18. A unitizing apparatus comprising:

(a) means for carrying an array of articles to be unitized;

(b) supply means for carrying a supply of stretchable adhesive tape, the tape being of the type which progressively detackifies when stretched;

(c) stretching means, arranged and configured to threadably receive the tape from said dispenser means, for automatically applying a stretching force to the tape and stretching the tape at predetermined intervals along its longitudinal axis, said stretching means including first, second, and third tape translation means for translating the tape at disparate speeds at predetermined times to stretch the tape, said disparate speeds occurring between said first and second tape translation means forming a first stretching zone, and said second and third tape translation means forming a second stretching zone and wherein said stretching means further comprises a plurality of clutches for creating said disparate speeds, whereby when said clutches are engaged said first and second tape translation means are powered and when said clutches are not engaged said first and second tape translation means free wheel; and (d) means for adhering the tape to the array by reducing the stretching force on the tape, including:

(1) means for creating relative rotation between said stretching means and said array carrying means, whereby the array to be taped rotates relative to said stretching means;

(2) elevation means, cooperatively connected to said stretching means, for elevating said stretching means in a predetermined manner relative to the array; and (3) controller means, operatively connected to said stretching means, for providing a control signal to selectively activate said stretching means to stretch the tape at desired locations responsive to the control signal, wherein the tape is adhered to the array except at said desired locations.

19. The apparatus of claim 18, wherein for stretched intervals of tape, the resultant desired final stretch percentage of the tape is achieved while maintaining the structural integrity of the tape, and wherein the tape is stretched to a ratio of about 6:1 by said first stretching zone and to a ratio of about 1.167:1 by said second stretching zone, resulting in a final stretching ratio of about 7:1.

20. A method for unitizing a plurality of articles, comprising the steps of:

(a) rotatably mounting a supply of stretch detackification adhesive tape, wherein the adhesive of the tape is detackified when said tape is stretched, said detackification being defined as the adhesive of the tape being reduced to an approximate level where it does not damage the surface of the articles to which it is applied;

(b) feeding the tape through a dispenser which transports the tape from the supply to a dispenser outlet;

(c) selectively stretching the tape in the dispenser by frictionally entraining the tape over a plurality of rotating curvilinear surfaces which either freewheel or are constrained to rotate at a predetermined rate, wherein when said curvilinear surfaces are rotated at said predetermined rate said curvilinear surfaces have a differing circumferential velocity with respect to one another thereby stretching the tape lying therebetween, and selectively reducing the stretching force on the tape by allowing the curvilinear surfaces to freewheel; whereby predetermined lengths of stretched and unstretched tape may be automatically and continuously delivered to the output;

(d) winding the tape about a take-up reel located proximate the outlet;

(e) rotatably mounting said take-up reel onto a hand-held device;

(f) moving said take-up reel about the articles while imparting up and down movements with said take-up reel so as to form a wrap pattern; and (g) adhering the tape to the articles at the predetermined lengths of unstretched tape, whereby the articles are unitized.

21. A method for unitizing a plurality of articles, comprising the steps of:

(a) rotatably mounting a supply of stretch detackification adhesive tape, wherein the adhesive of the tape is detackified when said tape is stretched, said detackification being defined as the adhesive of the tape being reduced to an approximate level where it does not damage the surface of the articles to which it is applied;

(b) feeding the tape through a dispenser which transports the tape from the supply to a dispenser output;

(c) selectively stretching the tape in the dispenser by frictionally entraining the tape over a plurality of rotating curvilinear surfaces which either freewheel or are constrained to rotate at a predetermined rate, wherein when said curvilinear surfaces are rotated at said predetermined rate said curvilinear surfaces have a differing circumferential velocity with respect to one another thereby applying a stretching force and stretching the tape lying therebetween, whereby predetermined lengths of stretched and unstretched tape may be automatically and continuously delivered to the output, and wherein said predetermined lengths of unstretched tape to be adhered to the articles are defined by reducing the stretching force on the tape; and (d) applying the tape from the dispenser output to the plurality of articles to unitize the articles, the tape applying step including the step of adhering the tape to the articles at said predetermined lengths of unstretched tape.

22. The method of claim 21, wherein said applying step comprises the steps of:

(a) rotating the plurality of articles to be unitized about a z-axis on a turntable, said z-axis being defined as an axis which is normal to a mean plane formed by said turntable; and (b) moving said dispenser vertically relative to the articles.

23. The method of claim 22, further comprising the following step: coordinating the rotation of the articles and the vertical movement of the apparatus, wherein predetermined wrap patterns may be formed with the tape to unitize the articles.

24. The method of claim 22, wherein said stretching step includes selectively engaging a clutch which is operatively connected to at least one of said curvilinear surfaces about which the tape is entrained, wherein said curvilinear surfaces to which said clutch is connected freewheel when said clutch is in a first state, and the tape is not stretched, and said curvilinear surfaces to which said clutch is connected are constrained to move at disparate speeds in order to stretch the tape lying therebetween when said clutch is in a second state.

25. The method of claim 24, wherein said stretching step includes use of two stretching zones by including first, second and third curvilinear surfaces, wherein the area between said first and said second curvilinear surfaces comprise a first stretching zone and the area between said second and said third curvilinear surfaces comprise a second stretching zone.

26. The method of claim 24, wherein said stretching step results in the tape being stretched to a final ratio of about 7:1 in those lengths which are stretched.

* * * * *

UNITED STATES PATENT AND TRADEMARK OFFICE
CERTIFICATE OF CORRECTION

PATENT NO. : 5,491,956

DATED : February 20, 1996

INVENTOR(S) : Donnelly et al.

It is certified that error appears in the above-identified patent and that said Letters Patent is hereby corrected as shown below:

On column (75), line Inventors, please insert --Mark E. Schwartz, Mahtomedi, Minn.-- after the word "Minn."

On column Abstract, line 13, please insert --)-- after the word "rotation"

On column 7, line 54, please delete "by one of the assignees" and substitute therefore --by the assignee--

Signed and Sealed this

Twenty-fourth Day of September, 1996

*Attest:*

Bruce Lehman

BRUCE LEHMAN

*Attesting Officer*

*Commissioner of Patents and Trademarks*